US012669261B2

(12) United States Patent
Tyberghein et al.

(10) Patent No.: US 12,669,261 B2
(45) Date of Patent: Jun. 30, 2026

(54) ADAPTIVE ECONOMIZER SECTION IN AIR HANDLING UNIT

(71) Applicants: Gerald Tyberghein, Minneapolis, MN (US); Robert Clarke Story, Saint Augustine, FL (US)

(72) Inventors: Gerald Tyberghein, Minneapolis, MN (US); Robert Clarke Story, Saint Augustine, FL (US)

(73) Assignee: MAS HVAC INC., Maple Grove, MN (US)

( * ) Notice: Subject to any disclaimer, the term of this patent is extended or adjusted under 35 U.S.C. 154(b) by 567 days.

(21) Appl. No.: 17/837,020

(22) Filed: Jun. 9, 2022

(65) Prior Publication Data

US 2022/0373222 A1 Nov. 24, 2022

Related U.S. Application Data

(60) Provisional application No. 63/221,478, filed on Jul. 13, 2021, provisional application No. 63/208,972, filed on Jun. 9, 2021.

(51) Int. Cl.
*F24F 13/14* (2006.01)
*F24F 12/00* (2006.01)

(52) U.S. Cl.
CPC ..... *F24F 13/14* (2013.01); *F24F 12/006* (2013.01)

(58) Field of Classification Search
CPC ... F24F 13/14; F24F 12/0006; F14F 2012/007
See application file for complete search history.

(56) References Cited

U.S. PATENT DOCUMENTS

2015/0096714 A1* 4/2015 Dagley ..... H05K 7/20836 165/8
2018/0039307 A1* 2/2018 Hay ..... G06F 1/20
2022/0003435 A1* 1/2022 Ge ..... F24F 3/1417

* cited by examiner

*Primary Examiner* — Steven B Mcallister
*Assistant Examiner* — Michael James Giordano
(74) *Attorney, Agent, or Firm* — Lippes Mathias LLP; Mitchell Ghaneie; Josephine Chen

(57) ABSTRACT

The present disclosure provides several embodiments of an adaptive, modular, energy recovery economizer section for a commercial air handling unit (AHU). The economizer section comprises an energy recovery device, a plurality of dampers, and a plurality of partition walls that allow the AHU to operate in a plurality of modes. Incorporation of the economizer section within the AHU avoids the need to split AHU into a stacked or side-by-side configuration. The economizer section may be integrated within OEM AHUs or retrofitted within existing AHUs. Retrofitting the economizer section within an existing AHU reduces the footprint of the retrofit. Moreover, when the economizer section is incorporated within an OEM AHU, the footprint and interior volume of the AHU are reduced relative to conventional OEM AHUs that comprise one or more energy recovery devices. Consequently, the economizer section improves material, fabrication, and transportation efficiencies without compromising performance of the AHU.

18 Claims, 32 Drawing Sheets

ADAPTIVE ECONOMIZER SECTION IN AIR HANDLING UNIT

RELATED APPLICATIONS

The present nonprovisional patent application claims the benefit of the filing date under 35 U.S.C. § 119(e) of Provisional Patent Application Ser. No. 63/208,972, filed on Jun. 9, 2021, and Provisional Patent Application Ser. No. 63/221,478, filed on Jul. 13, 2021.

FIELD OF INVENTION

This invention is generally related to the heating, ventilation, and air conditioning industry and more specifically related to integration of energy recovery devices within commercial air handling units.

BACKGROUND

Conventional commercial air handling units (AHU) which utilize one or more energy recovery devices require stacked or side-by-side configurations. Such conventional configurations have parallel air streams in one or more sections of the AHU and result in several disadvantages. For example, incorporation of energy recovery devices within conventional AHUs can significantly increase the footprint of the AHU as well as cost and time involved with retrofitting an existing AHU. Furthermore, when energy recovery devices are incorporated into conventionally designed OEM AHUs they require the volume of the air tunnel be enlarged (either height for stacked configurations or width for side-by-side configurations) to accommodate the additional airstreams resulting from utilizing the one or more energy recovery devices. Accordingly, what is needed is an adaptive and modular energy recovery economizer section which does not sacrifice performance of the AHU or require the footprint or volume of other sections of the AHU to be significantly altered by the incorporation of the economizer section.

BRIEF SUMMARY OF THE INVENTION

The present disclosure provides an adaptive, modular, energy recovery economizer section for commercial air handling units, hereinafter referred to as "AHUs". AHUs comprise an air tunnel further comprised of a plurality of sections. The plurality of sections comprises the adaptive and modular energy recovery economizer section, hereinafter the "economizer section," and a plurality of other sections. The plurality of other sections comprises a return air plenum section, a return fan section, a filter section, and a plurality of downstream sections.

The economizer section comprises a first economizer compartment, a second economizer compartment, a third economizer compartment, a fourth economizer compartment, a section housing, an energy recovery device, a plurality of dampers, and a plurality of partition walls. The energy recovery device, plurality of dampers, and plurality of partition walls are provided within the section housing.

When the economizer section is attached or retrofitted to the AHU, it allows the AHU to operate in a plurality of modes without splitting one or more sections of the plurality of other sections. The plurality of modes comprises a normal mode, an economizer mode, and a morning warm-up mode. The energy recovery device, plurality of dampers, and plurality of partition walls allow the economizer section to have a reduced interior volume without compromising performance of the AHU.

Additionally, the energy recovery device, plurality of dampers, and plurality of partition walls allows for omission of a plurality of longitudinal partition walls in one or more sections of the plurality of other sections. The plurality of longitudinal partition walls is conventionally used to separate airflow paths of outdoor air and return air. Accordingly, the omission of the plurality of longitudinal partition walls dramatically improves material, fabrication, and transportation efficiencies.

The energy recovery device may comprise a rotary enthalpy wheel or, alternatively, a plate heat exchanger device, such as a fixed enthalpy plate. Furthermore, the type of energy recovery device influences the location of the plurality of dampers within the economizer section. The plurality of dampers control the airflow paths of the return air and outside air within the air tunnel.

The economizer section provides a plurality of advantages which include: (1) no dependency on connection locations of return air and outside air; (2) no dependency on fan types used within the AHU; and (3) may be retrofitted within existing AHUs without modification to the internal components of the existing AHU's return air plenum section, return fan section, filter section or any other sections within the air tunnel.

REFERENCE NUMBERS

Figure 1:
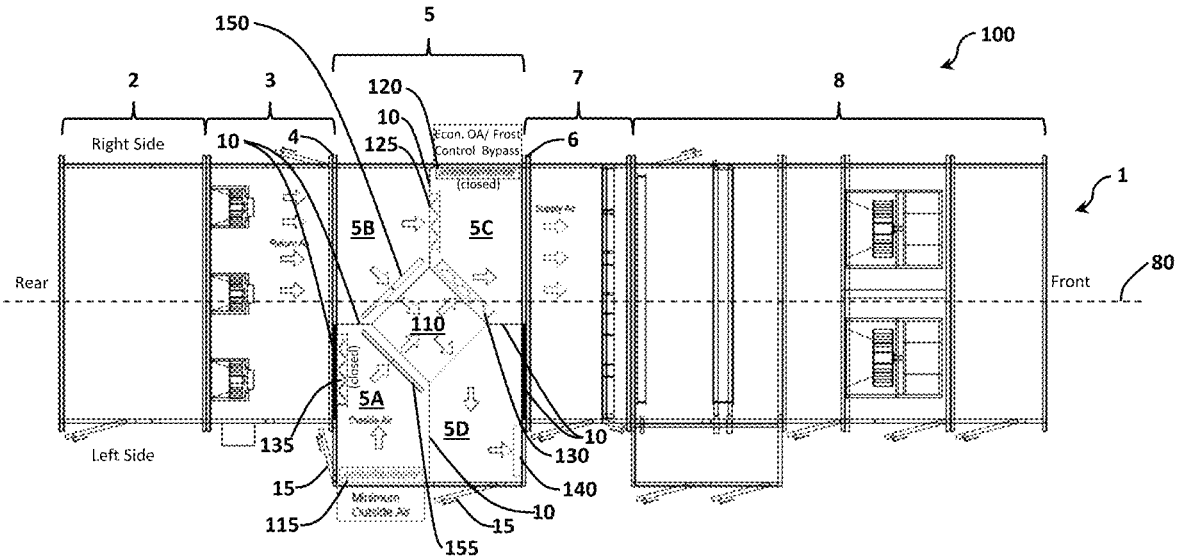
FIG. 1 is a top view of an outdoor AHU, the roof of which being removed from view, for a first embodiment of an economizer section with fixed enthalpy plates, wherein directional arrows schematically depict the airflow within the economizer section during the normal mode of operation.
Figure 2:
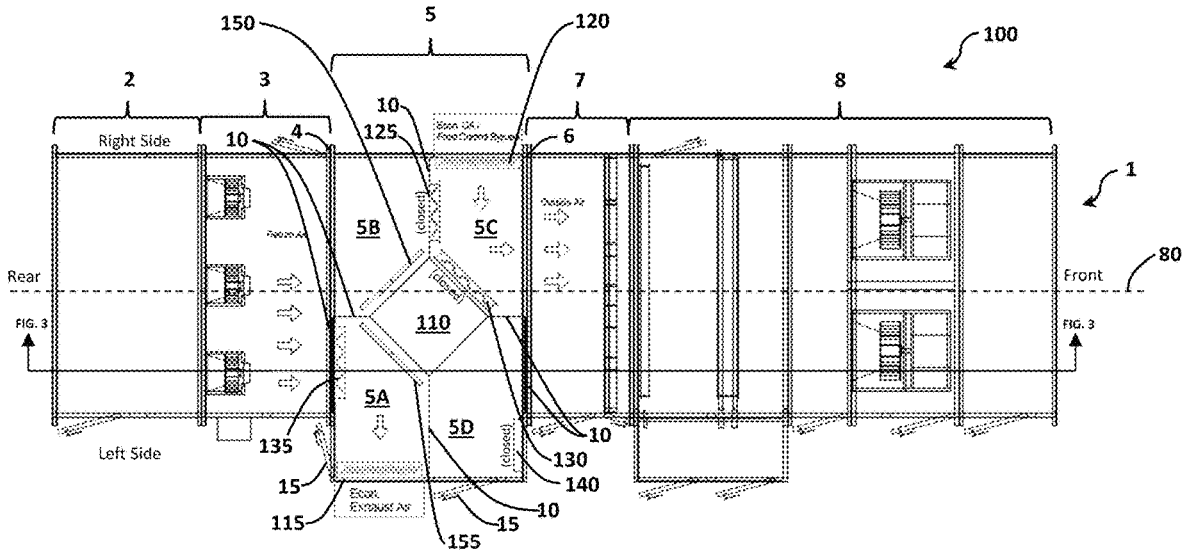
FIG. 2 is a top view of the outdoor AHU, the roof of which being removed from view, for the first embodiment of the economizer section with fixed enthalpy plates, wherein directional arrows schematically depict the airflow within the economizer section during the economizer mode of operation.
Figure 3:
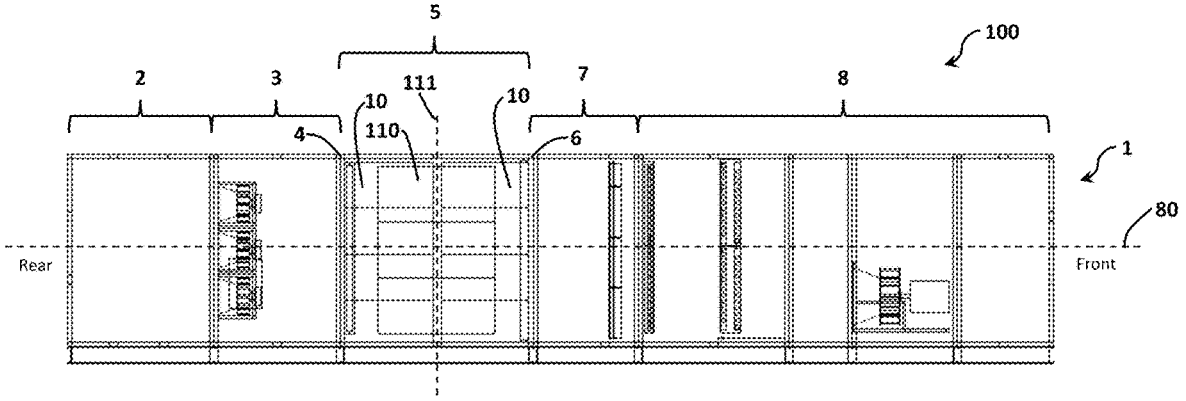
FIG. 3 is a longitudinal cross-sectional view of the outdoor AHU, taken along line 3-3 from FIG. 2, for the first embodiment of the economizer section with fixed enthalpy plates.

1—Air handling unit
2—Return air plenum section
3—Return fan section
4—First end
5—Economizer section
5A—First economizer compartment
5B—Second economizer compartment
5C—Third economizer compartment

5D—Fourth economizer compartment
6—Second end
7—Filter section
8—Plurality of downstream sections
10—Plurality of partition walls
15—Plurality of access doors
80—Longitudinal axis
100—First embodiment
110—Fixed enthalpy plates
111—Vertical axis
115—First damper
120—Second damper
125—Recirculation damper
130—Plate bypass damper
135—Return air bypass damper
140—Exhaust damper
150—Return air filter
155—Outside air filter
200—Second embodiment
210—Rotary enthalpy wheel
215—First damper
220—Second damper
225—Recirculation damper
235—Return air bypass damper
240—Exhaust damper
250—Return air filter
255—Outside air filter
300—Third embodiment
310—Rotary enthalpy wheel
315—First damper
320—Second damper
325—Recirculation damper
330—Third damper
340—Exhaust damper
350—Return air filter
355—Outside air filter
400—Fourth embodiment
410—Fixed enthalpy plates
411—Vertical axis
415—First damper
420—Second damper
425—Recirculation damper
430—Third damper
440—Exhaust damper
450—Return air filter
455—Outside air filter

DETAILED DESCRIPTION OF THE EMBODIMENTS

The present disclosures provides an adaptive, modular energy recovery section 5 for a commercial air handling unit 1, hereinafter referred to as the "AHU 1". The AHU 1 comprises an air tunnel that is comprised of a plurality of sections and a longitudinal axis 80. The plurality of sections comprises the adaptive, modular, energy recovery economizer section 5, hereinafter the "economizer section 5," and a plurality of other sections. The plurality of other sections comprises a return air plenum section 2, a return fan section 3, a filter section 7, and a plurality of downstream sections 8. The plurality of downstream sections 8 may include a heating/cooling coil section, one or more supply fan sections, or one or more supply air plenum sections. Additionally, each section of the plurality of other sections comprises a substantially consistent cross-sectional area, which further comprises a substantially uniform predetermined width and predetermined height.

Conventionally, AHUs 1 that incorporate an energy recovery device utilize a stacked configuration or a side-by-side configuration to separate a return airflow and an outside airflow. Such stacked and side-by-side configurations require longitudinally splitting two or more sections of the plurality of other sections with a plurality of longitudinal partitions walls to separate the return airflow and outside airflow. Splitting two or more sections within the AHU 1 is costly and inefficient.

The economizer section 5 provides a plurality of advantages relative to AHUs 1 that conventionally incorporate energy recovery devices. The plurality of advantages include: (1) no dependency on connection locations of return air and outside air; (2) no dependency on fan types used within the AHU 1; and (3) the capability of being retrofitted within an existing AHU without modification to the internal components of the existing AHU's return air plenum section 2, return fan section 3, filter section 7 or any other sections within the air tunnel.

The economizer section 5 comprises a first end 4, a second end 6, a central axis, a section housing, at least one energy recovery device, and a plurality of dampers. The central axis of the economizer section 5 is substantially parallel with the longitudinal axis of the air tunnel 80 and in some embodiments is substantially colinear. The economizer section 5 further comprises a plurality of compartments, wherein the plurality of compartments comprise a first economizer compartment 5A, a second economizer compartment 5B, a third economizer compartment 5C, a fourth economizer compartment 5D.

The section housing comprises a variety of structural elements and a plurality of partition walls 10. Each partition wall of the plurality of partition walls 10 is secured to one or more structural elements of the variety of structural elements. The variety of structural elements comprises a roof, a floor, a plurality of exterior walls. Each economizer compartment 5A, 5B, 5C, 5D is bounded by a plurality of bounding sides. The plurality of bounding sides for each respective economizer compartment 5A, 5B, 5C, 5D comprises at least one exterior wall of the plurality of exterior walls, one or more partition walls of the plurality of partition walls 10, and one or more vertical surfaces of the energy recovery device.

The energy recovery device and plurality of dampers are securely attached to the section housing. When the economizer section 5 is utilized within an outside AHU 1 (as exemplified in the First and Second Embodiments disclosed herein), three exterior walls of the plurality of exterior walls form an extended portion of the economizer section 5, which enlarges the footprint of the first and fourth economizer compartments 5A, 5D, as shown in FIGS. 1, 2, 9, and 10. The extended portion extends out a predetermined distance on one side of the air tunnel. However, it is anticipated that another extended portion may extend from the second and third economizer compartments 5B, 5C.

The economizer section 5 further comprises a plurality of access doors 15 as well as a first end 4 and a second end 6. The first and second ends 4,6 are separated by a predetermined length. The first end 4 attaches to the return fan section 3 and the second end 6 attaches to the filter section 7, as shown in FIGS. 1-3, 9-11, 19, 20, 27, and 28. Additionally, the economizer section 5 comprises a predetermined width, measured substantially orthogonally relative to the longitudinal axis of the air tunnel 80. The predetermined width of the economizer section 5 may be greater than the predetermined width of the plurality of other sections.

The present disclosure comprises four embodiments, respectively described herein, as follows: (1) Economizer section with fixed enthalpy plates for an outdoor AHU; (2) Economizer section with a rotary enthalpy wheel for an outdoor AHU; (3) Economizer section with a rotary enthalpy wheel for an indoor AHU; and (4) Economizer section with fixed enthalpy plates for an indoor AHU.

First Embodiment

A first embodiment 100 of the present disclosure comprises an economizer section 5 for use within an outdoor AHU 1, as shown in FIGS. 1-8, which may be operated in a plurality of modes. The plurality of modes comprises a normal mode of operation, an economizer mode, and a morning warm-up mode. However, it is anticipated that the economizer section 5 may accommodate AHUs which require other modes of operation, such as daytime warm-up mode.

The economizer section 5 further comprises fixed enthalpy plates 110. Alternatively, in higher capacity AHUs 1 a plurality of stacks of fixed enthalpy plates 110 may be used (not shown). The fixed enthalpy plates 110 comprise a substantially rectangular cuboid profile with six surfaces. The six surfaces are preferably comprised of four substantially vertical surfaces and two substantially horizontal surfaces. Each vertical surface forms a distinct bounding side of the plurality of bounding sides for the economizer compartments 5A, 5B, 5C, 5D. The vertical surface which bounds the first economizer compartment 5A provides an outside air filter 155, as shown in FIG. 1. The vertical surface which bounds the second economizer compartment 5B provides a return air filter 150, as shown in FIG. 1.

The first economizer compartment 5A, is bounded by three partition walls of the plurality of partition walls 10, two exterior walls of the section housing, and one vertical surface of the four vertical surfaces of the fixed enthalpy plates 110, as shown in FIG. 1. One of the three partition walls spans along the first end 4 of the economizer section 5 and provides a return air bypass damper 135. One of the two exterior walls that bound the first economizer compartment 5A comprises a first damper 115 and the other provides an access door of the plurality of access doors 15. The return air bypass damper 135 is substantially closed during normal mode of operation and substantially open during economizer mode.

The second economizer compartment 5B, is open to the adjacent return fan section 3, such that the return airflow can flow substantially unobstructed from the return fan section 3 to the second economizer compartment 5B. The second economizer compartment 5B is bounded by two partition walls of the plurality of partition walls 10, one of which it shares with the first economizer compartment 5A and the other which it shares with the third economizer compartment 5C. The second economizer compartment 5B is also bound by one exterior wall of the plurality of exterior walls. The partition wall which spans between the fixed enthalpy plates 110 and the exterior wall, which is also shared by the third economizer compartment 5C, provides a recirculation damper 125, as shown in FIG. 1. The recirculation damper 125 is substantially open during normal mode of operation and substantially closed during economizer mode.

The third economizer compartment 5C, is open to the adjacent filter section 7 such that the return airflow and/or the outside airflow, depending on the mode of operation, may flow substantially unobstructed from the third economizer compartment 5C to the filter section 7. The third economizer compartment 5C is bound by two partition walls of the plurality of partition walls, one of which it shares with the second economizer compartment 5B and the other which is shares with the fourth economizer compartment 5D. Additionally, it is also bound by one exterior wall of the plurality of exterior walls and one of the vertical surfaces of the fixed enthalpy plates 110, as shown in FIG. 1. The exterior wall that the third economizer compartment 5C is bound by provides a second damper 120, which is closed during the normal mode of operation and open during economizer mode. Additionally, the vertical surface of the fixed enthalpy plates 110 that bounds the third economizer compartment 5C, also provides a plate bypass damper 130. The plate bypass damper 130 is open during the normal mode of operation and closed during the economizer mode of operation.

The fourth economizer compartment 5D is bound by three partition walls of the plurality of partition walls 10, two exterior walls of the plurality of exterior walls, and by one vertical surface of the fixed enthalpy plates 110, as shown in FIG. 1. One of the two exterior walls comprises an exhaust damper 140 and the other may optionally comprise an access door of the plurality of access doors 15, as shown in FIG. 1.

The fixed enthalpy plates 110 are positioned such that the direction of the airflows (also referred to as airstreams) which pass through the fixed enthalpy plates 110 are each respectfully directed at a substantially 45-degree angle relative to the longitudinal axis of the air tunnel 80. During normal mode of operation, the return air and outside air airstreams respectively flow substantially perpendicular relative to each other as well as relative to a vertical axis 111 of the fixed enthalpy plates 110, as shown in FIG. 1.

During the normal mode of operation, a predetermined minimum airflow volume of outside air is pulled through the first damper 115 such that it traverses from the first economizer compartment 5A through the fixed enthalpy plates 110 to the third economizer compartment 5C wherein it mixes with the airflow of the return air and proceeds into the filter section 7 and, subsequently, the plurality of downstream sections 8. Concurrently, the airflow of the return air is directed from the return air plenum section 2 through the return fan section 3 into the second economizer compartment 5B wherein a majority of the airflow volume passes through the recirculation damper 125. The portion of the airflow volume of the return air that does not pass through the recirculation damper 125 is directed through the fixed enthalpy plates 110 and into the fourth economizer compartment 5D wherein it is exhausted through the exhaust damper 140.

Additionally, during the normal mode of operation the plate bypass damper 130, and recirculation damper 125 are all actuated to a substantially open position. Conversely, the return air bypass damper 135 and the second damper 120 are actuated to a substantially closed position. Also, during normal operation, the first damper 115 is modulated partially open. The exhaust damper 140 is actively controlled and modulated to a closed position during economizer mode. However, it is anticipated that the exhaust damper 140 may, alternatively, be passively controlled.

During the economizer mode, the supply air is substantially comprised entirely of outside air, which is pulled into the third economizer compartment 5C through the second damper 120, and the return air is exhausted through the first damper 115 and the exhaust damper 140. Accordingly, the recirculation damper 125 and plate bypass damper 130 are actuated to a substantially closed position and the first damper 115, second damper 120, and return air bypass damper 135 are all actuated to a substantially open position.

Second Embodiment

A second embodiment 200 of the present disclosure comprises an economizer section 5 for use within an outdoor AHU 1, as shown in FIGS. 9-18, which may be operated in a plurality of modes. The plurality of modes comprises a normal mode of operation, an economizer mode, and a morning warm-up mode. However, it is anticipated that the economizer section 5 may accommodate AHUs which require other modes of operation, such as daytime warm-up mode.

Figure 4:
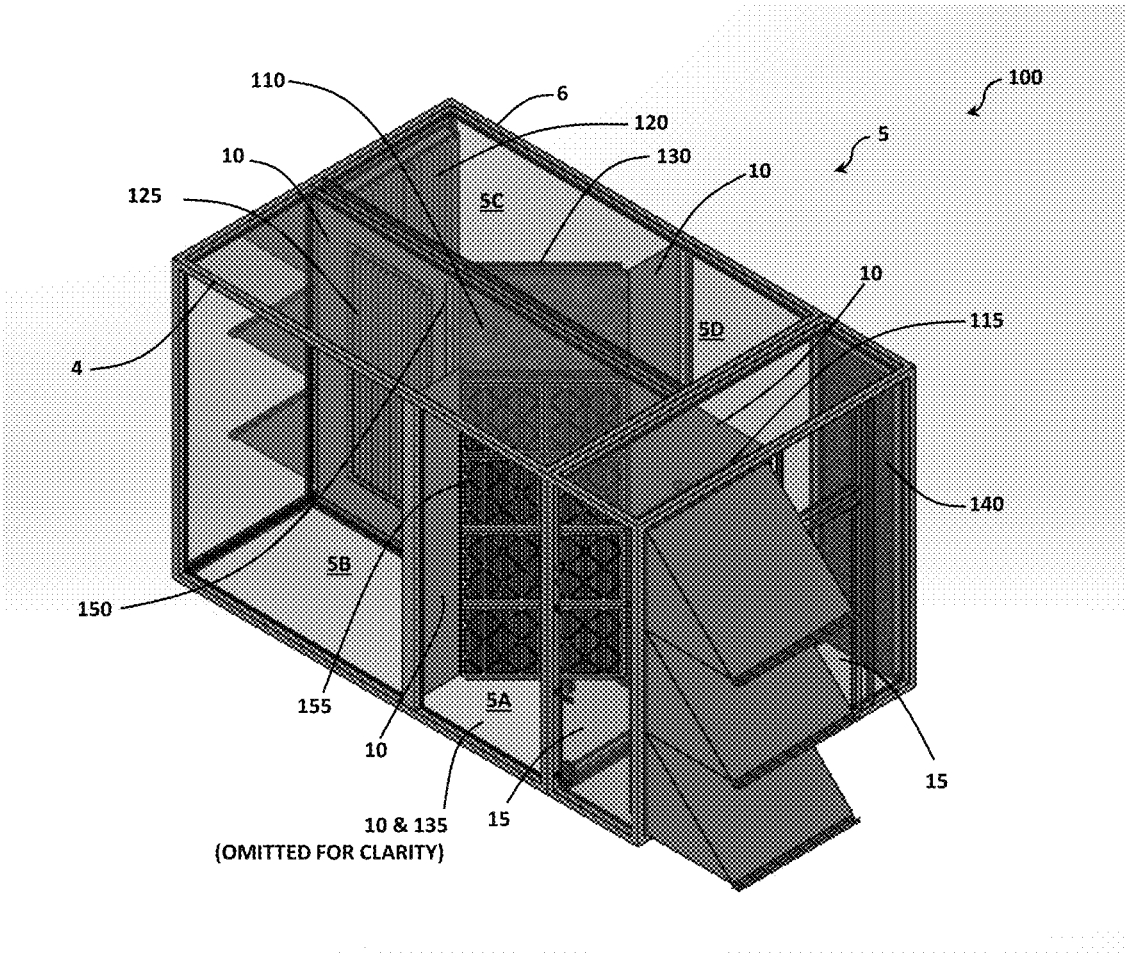
FIG. 4 is a left rear perspective view of the economizer section of the first embodiment of the outdoor AHU, wherein the roof and exterior walls of the section housing are shown opaque and a partition wall, which provides the return air bypass damper, is removed from view.
Figure 5:
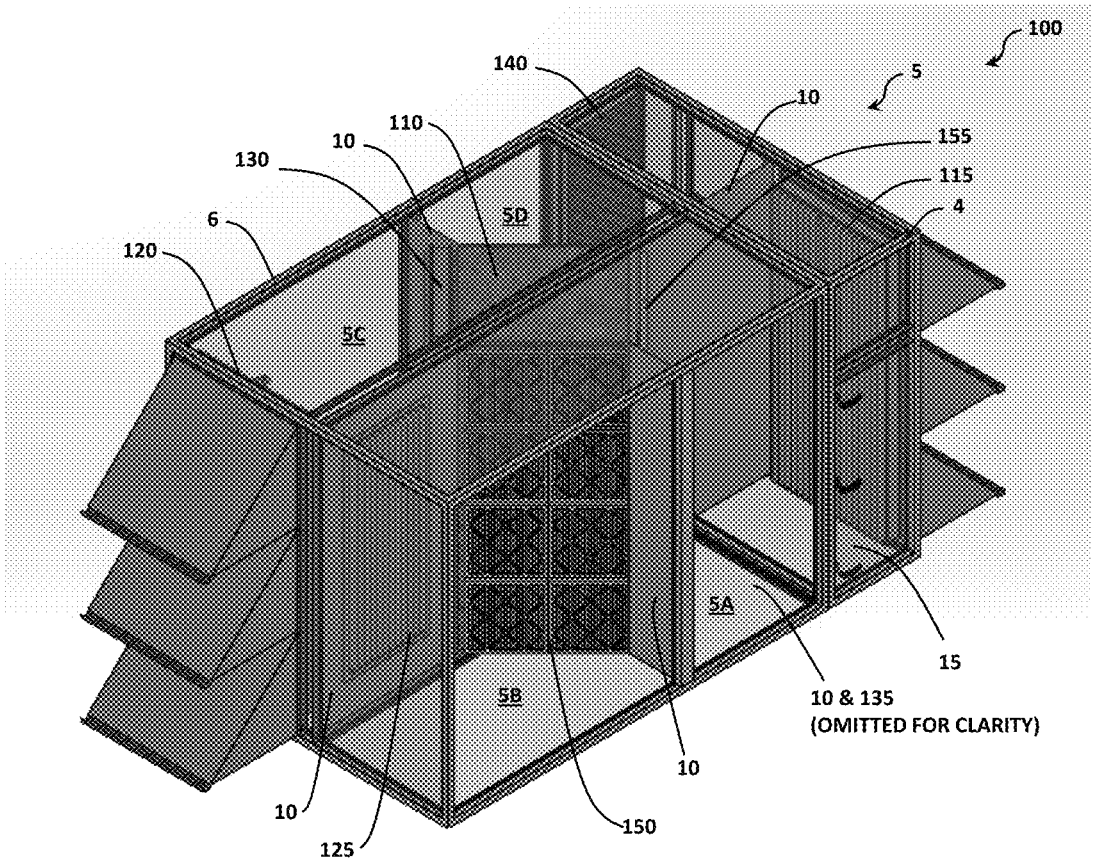
FIG. 5 is a right rear perspective view of the economizer section of the first embodiment of the outdoor AHU, wherein the roof and exterior walls of the section housing are shown opaque and the partition wall, which provides the return air bypass damper, is removed from view.
Figure 6:
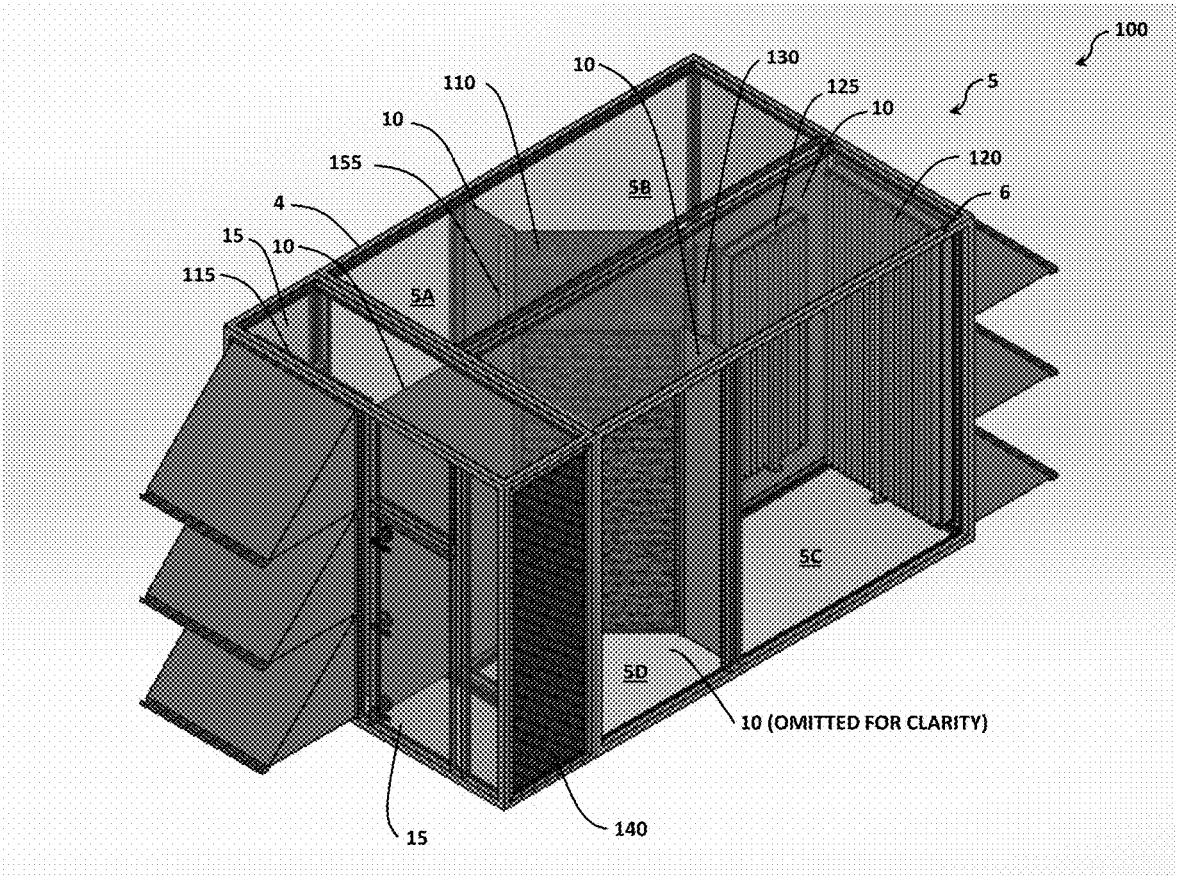
FIG. 6 is a left front perspective view of the economizer section of the first embodiment of the outdoor AHU, wherein the roof and exterior walls of the section housing are shown opaque, and a partition wall bounding the fourth economizer compartment is removed from view.
Figure 7:
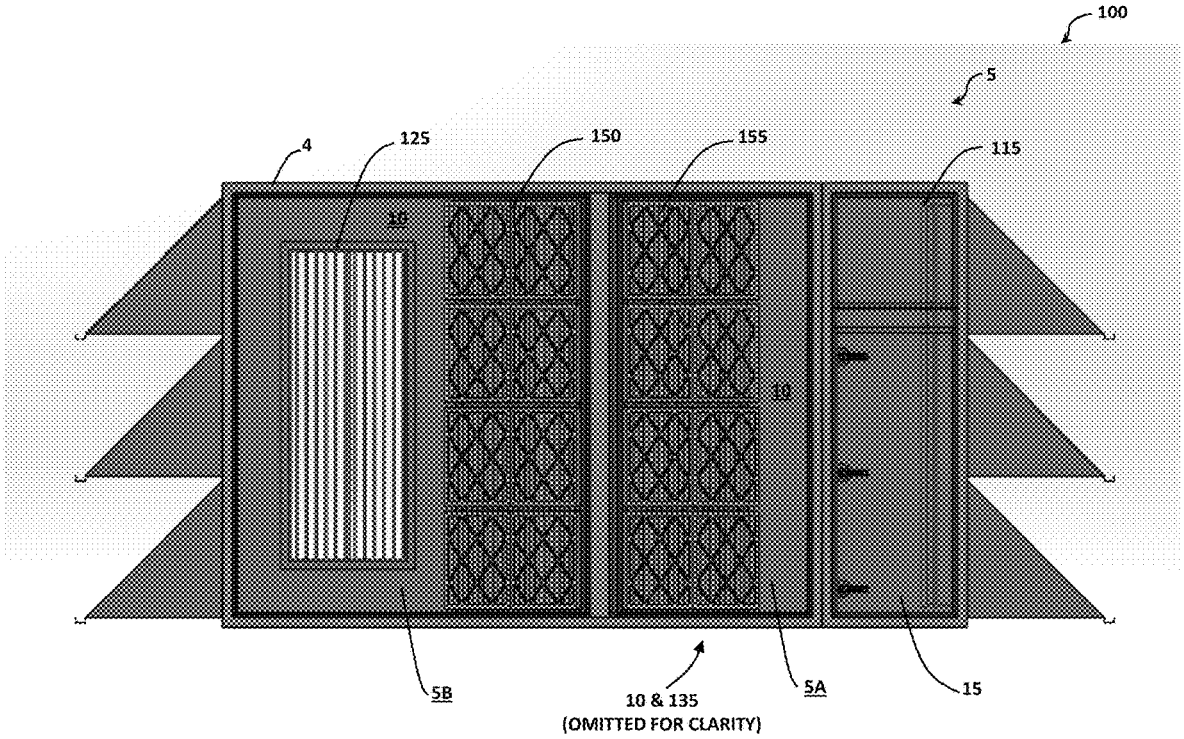
FIG. 7 is a rear view of the economizer section of the first embodiment of the outdoor AHU, wherein the partition wall, which provides the return air bypass damper, is removed from view.
Figure 8:
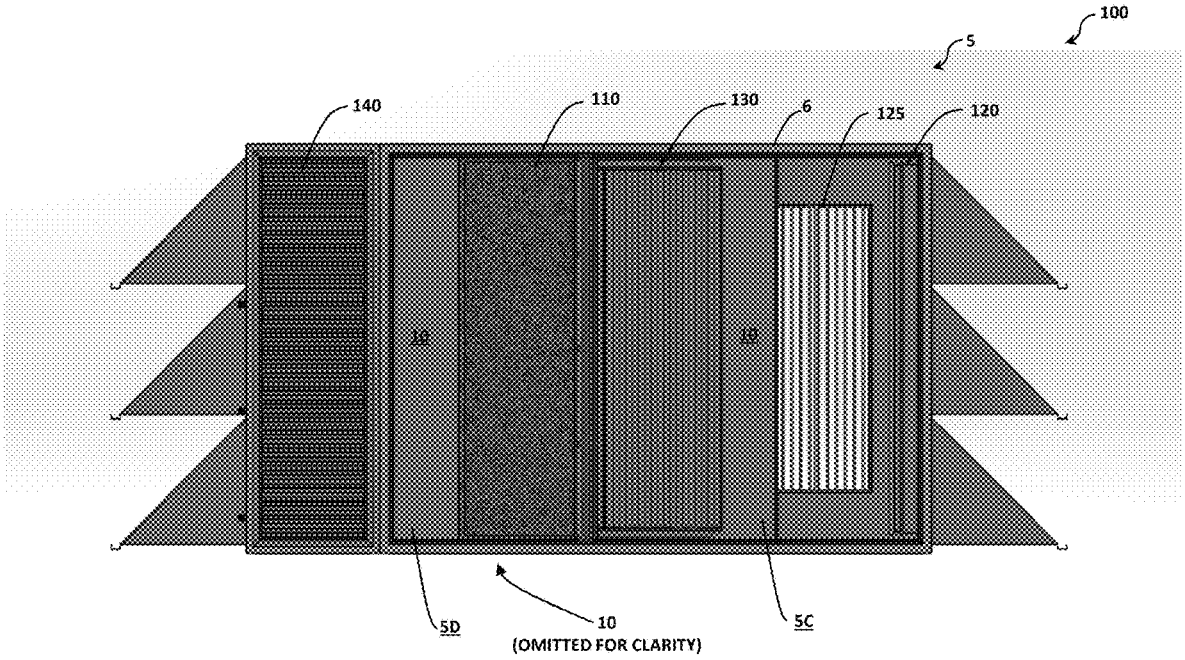
FIG. 8 is a front view of the economizer section of the first embodiment of the outdoor AHU, wherein the partition wall bounding the fourth economizer compartment is removed from view.

The economizer section 5 further comprises a rotary enthalpy wheel 210. Alternatively, in higher capacity AHUs a plurality of rotary enthalpy wheels 210 may be used (not shown). The rotary enthalpy wheel 210 comprises a substantially disc shape and is oriented such that the axis which it rotates about is substantially orthogonal to the longitudinal axis of the air tunnel 80. The economizer compartments 5A, 5B, 5C, 5D are each adjacent to a portion of the rotary enthalpy wheel 210, as shown FIGS. 4 and 5. The rotary enthalpy wheel 210 provides an outside air filter 255 in the second and fourth economizer compartments 5B, 5D, as shown in FIG. 4.

Figure 9:
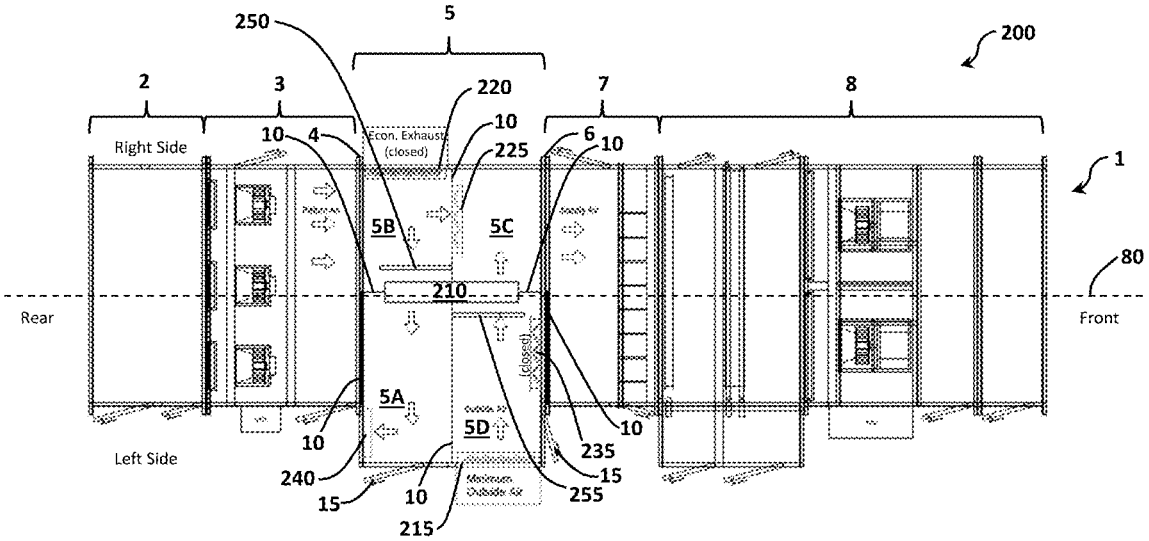
FIG. 9 is a top view of an outdoor AHU, the roof of which being removed from view, for a second embodiment of the economizer section with an energy recovery wheel, wherein directional arrows schematically depict the airflow within the economizer section during the normal mode of operation.
Figure 10:
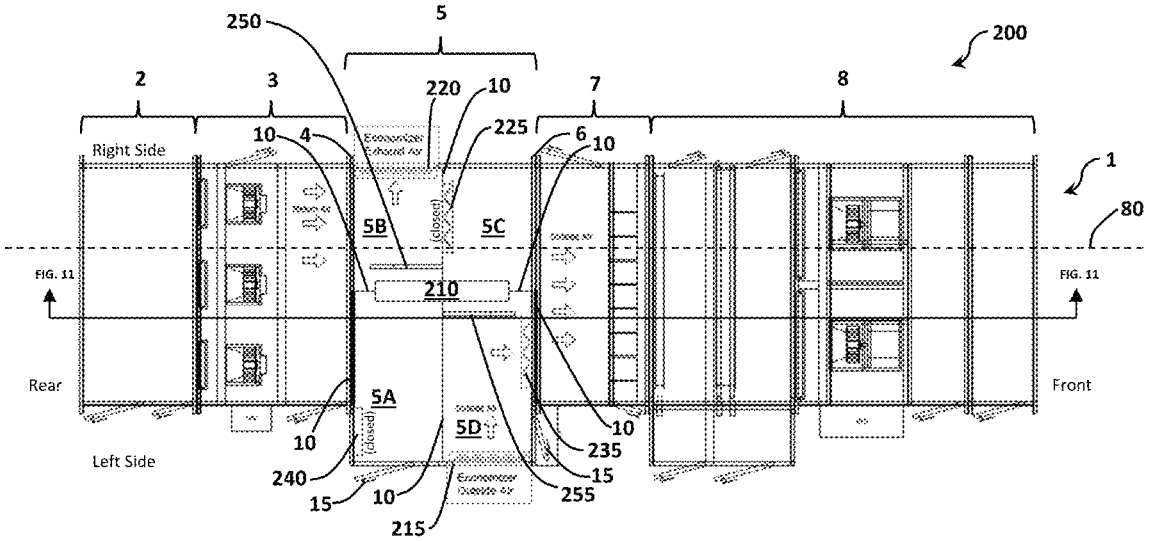
FIG. 10 is a top view of the outdoor AHU, the roof of which being removed from view, for the second embodiment of the economizer section with the energy recovery wheel, wherein directional arrows schematically depict the airflow within the economizer section during the economizer mode of operation.
Figure 11:
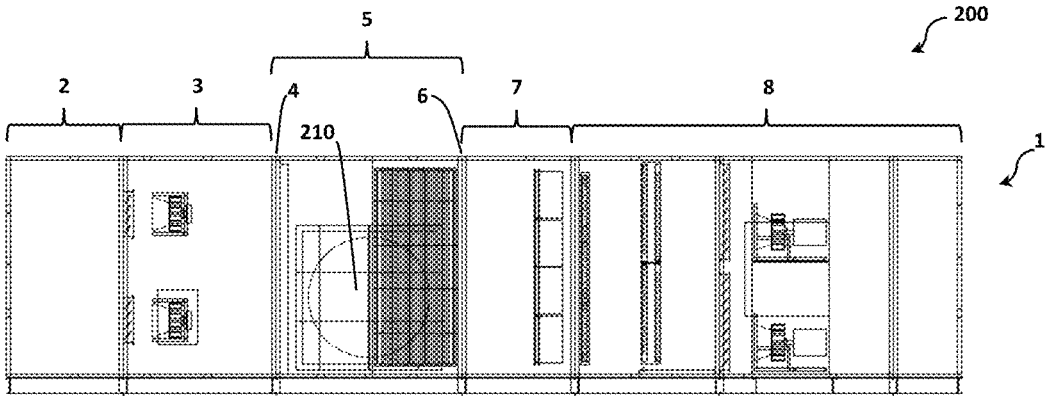
FIG. 11 is a longitudinal cross-sectional view of the outdoor AHU, taken along line 11-11 from FIG. 10, for the second embodiment of the economizer section with the energy recovery wheel.
Figure 12:
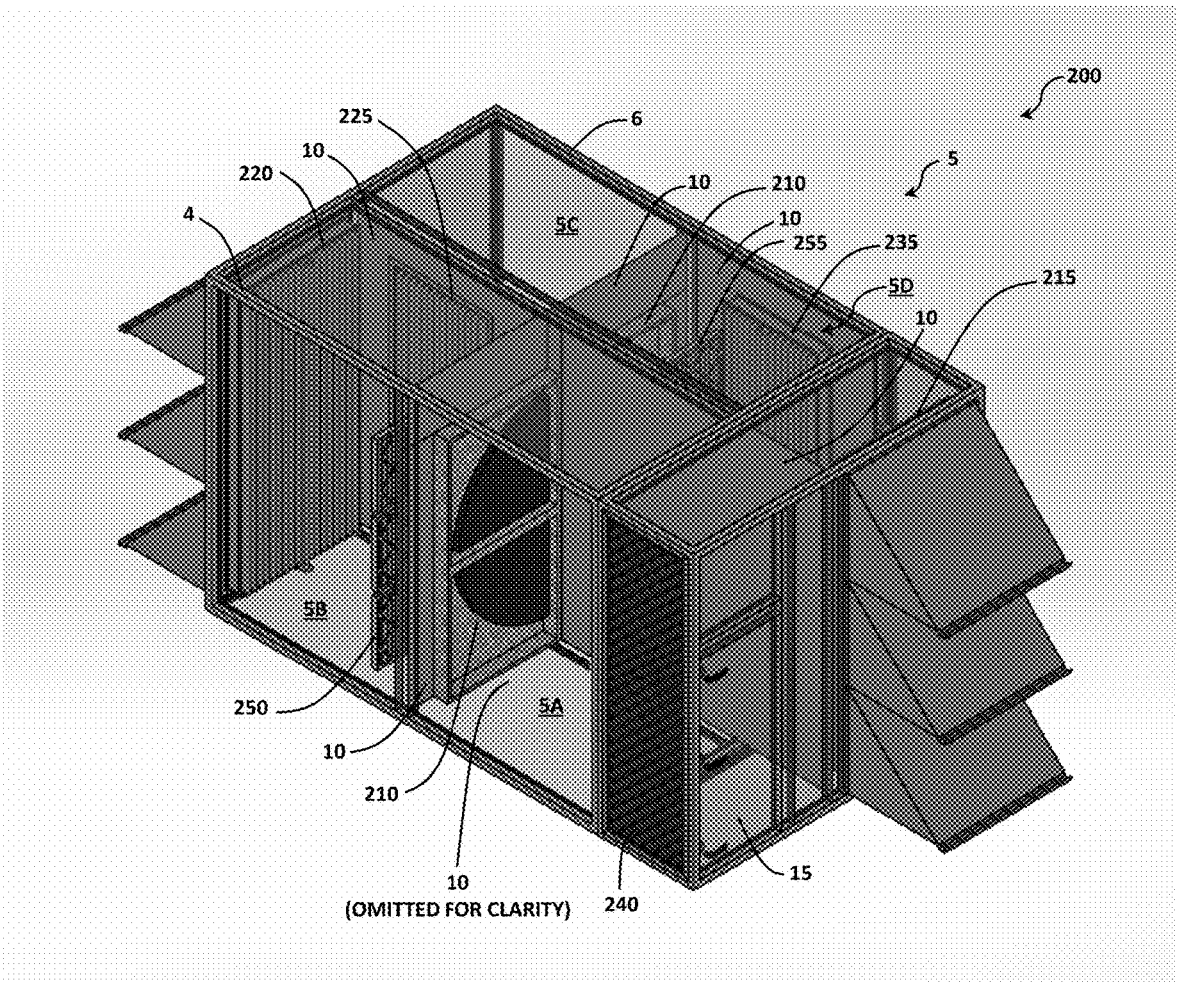
FIG. 12 is a left rear perspective view of the second embodiment of the economizer section for the outdoor AHU, wherein the roof and exterior walls of the section housing are shown opaque and the partition wall separating a first economizer compartment from an adjacent section of the AHU is removed from view.

The first economizer compartment 5A, as shown in FIGS. 9 and 10, is bounded by the rotary enthalpy wheel 210, three partition walls of the plurality of partition walls, and two exterior walls of the plurality of exterior walls, as shown in FIG. 12. The two exterior walls may comprise either an air exhaust opening 240 or an access door of the plurality of access doors 15.

Figure 15:
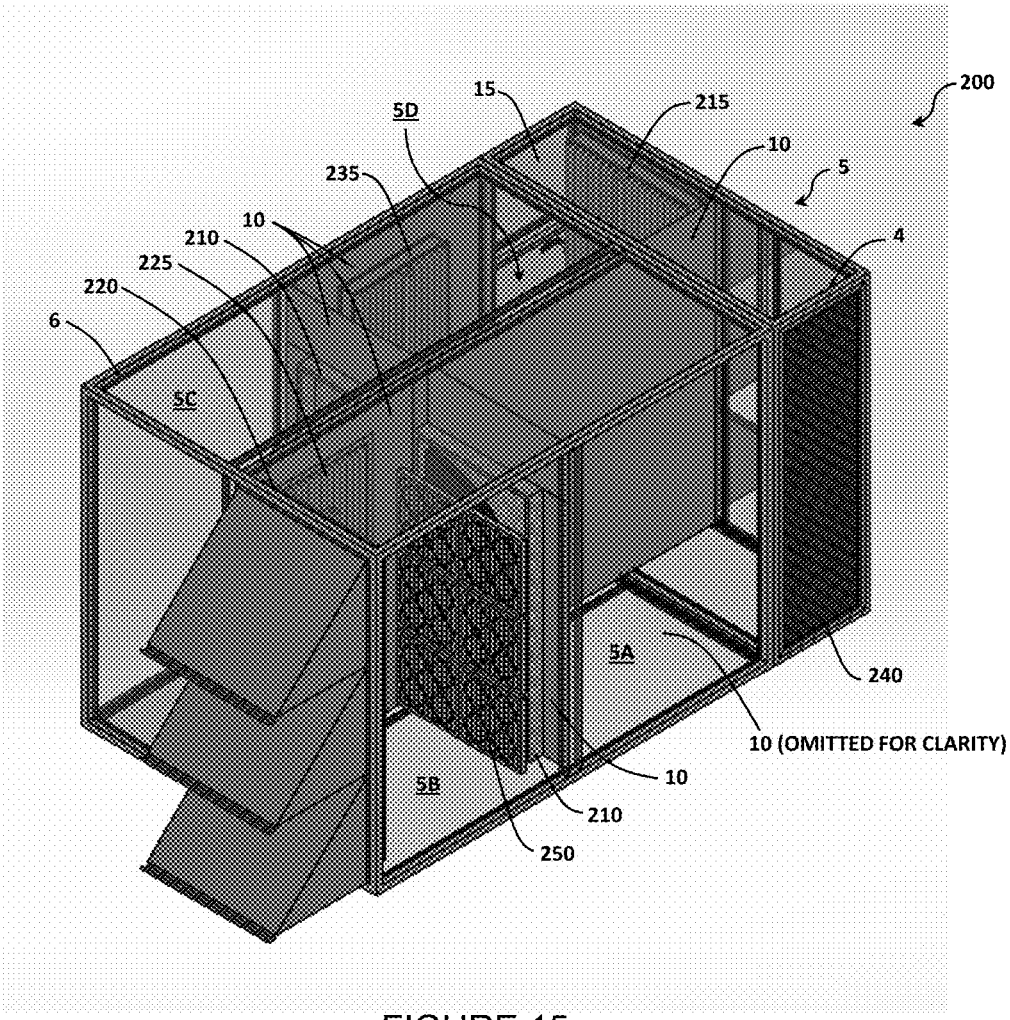
FIG. 15 is a right rear perspective view of the economizer section of the second embodiment of the outdoor AHU, wherein the roof and exterior walls of the section housing are shown opaque and the partition wall separating a first economizer compartment from an adjacent section of the AHU is removed from view.
Figure 16:
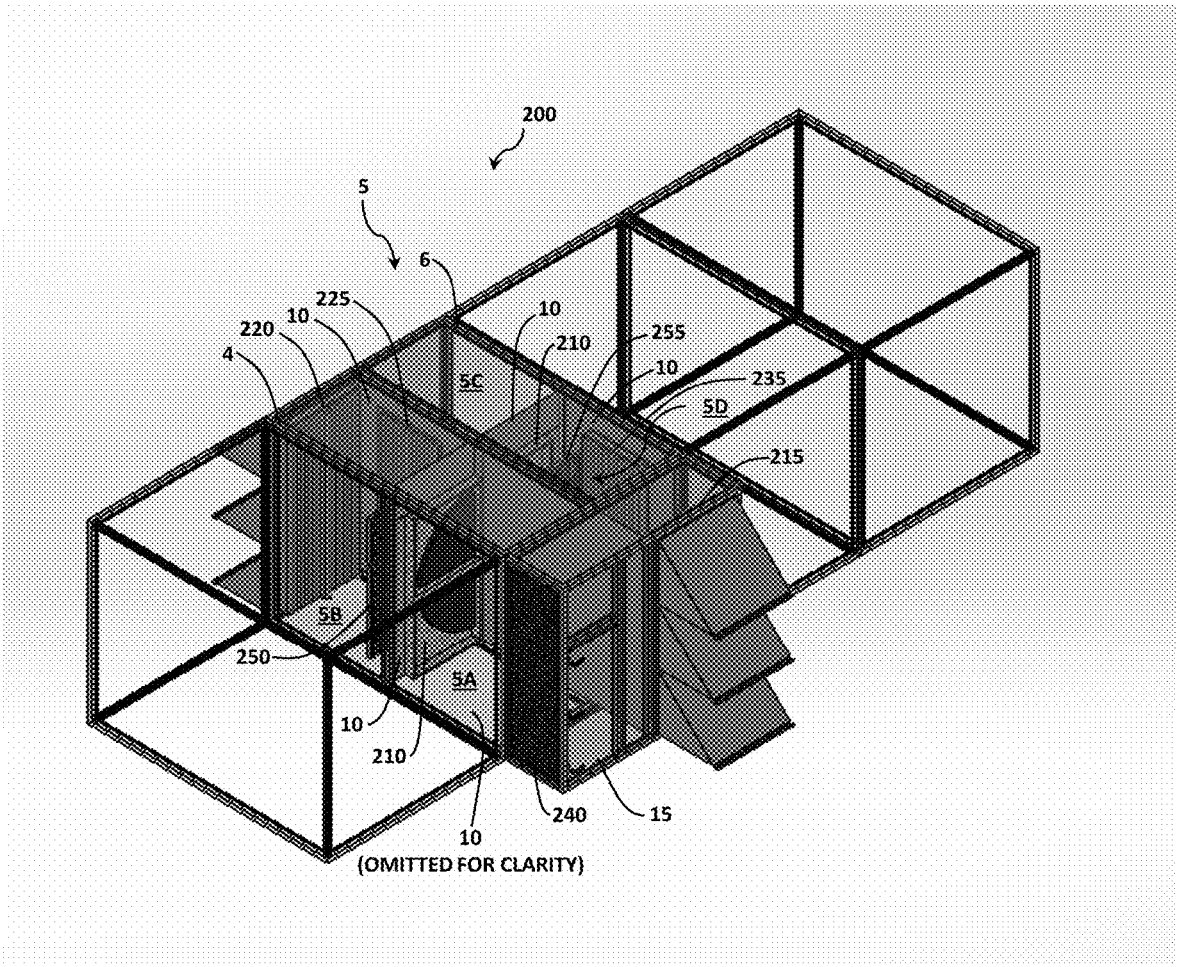
FIG. 16 is left rear perspective view of the economizer section of the second embodiment shown within a shell of an outdoor AHU, wherein the roof and exterior walls of the economizer section are shown opaque, the roof and exterior walls of the other sections' housing have been removed from view, and the partition wall separating a first economizer compartment from an adjacent section of the AHU is removed from view.
Figure 17:
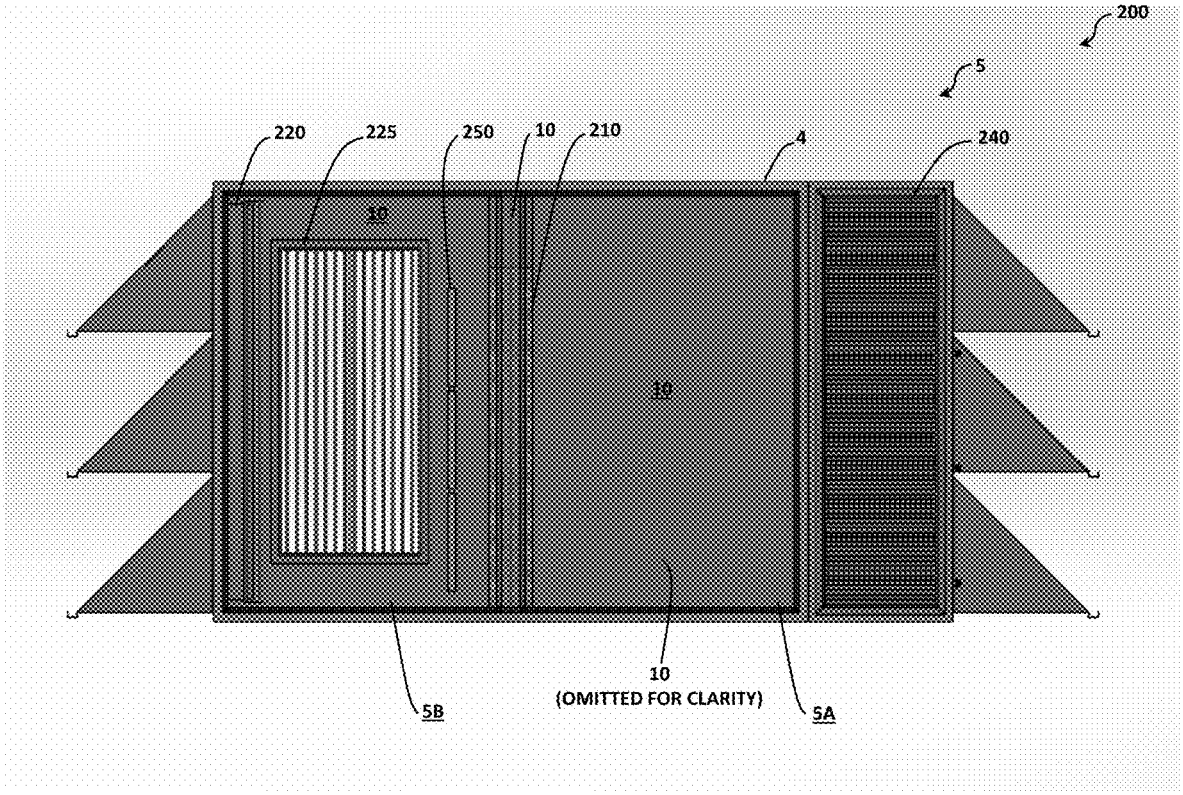
FIG. 17 is a rear view of the economizer section of the second embodiment of the outdoor AHU, wherein the partition wall separating a first economizer compartment from an adjacent section of the AHU is removed from view.
Figure 18:
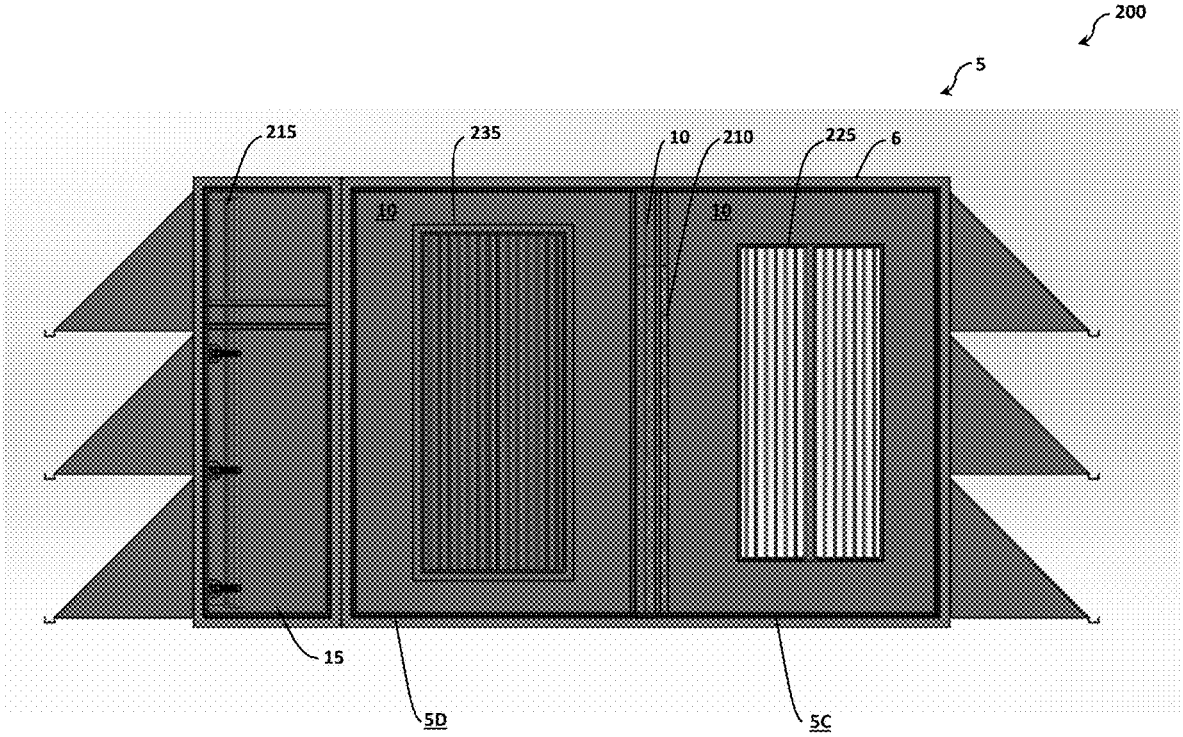
FIG. 18 is a front view of the economizer section of the second embodiment of the outdoor AHU, wherein the rear exterior wall of the section housing is shown opaque.

The second economizer compartment 5B, is open to the adjacent return fan section 3, such that the return airflow can flow unobstructed from the return fan section 3 to the second economizer compartment 5B. The second economizer compartment 5B comprises at least two bounding sides consisting of partition walls of the plurality of partition walls. Additionally, the second economizer compartment 5B comprises at least one bounding side that consists of an exterior wall of the section housing. The partition wall which substantially spans from the center of the rotary enthalpy wheel 210 to the adjacent exterior wall, as shown in FIG. 15, provides a recirculation damper 225. The recirculation damper 225 is substantially open during normal mode of operation and substantially closed during economizer mode. The exterior wall bounding the second economizer compartment 5B provides a second damper 220. The second damper 220 is substantially closed during normal mode of operation and substantially open during economizer mode. A return air filter 250 is secured to the partition wall separating the second and third economizer compartments 5B, 5C.

Figure 13:
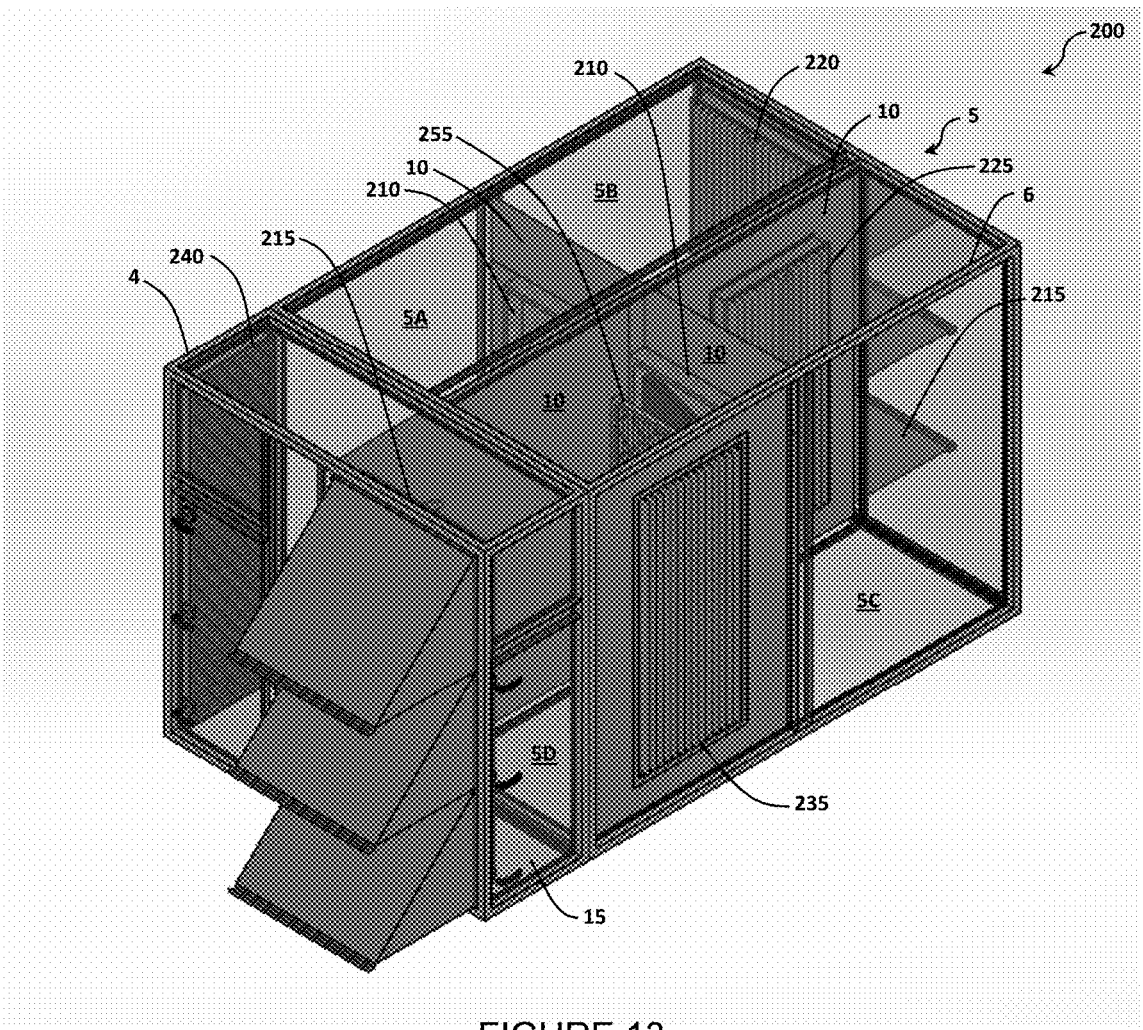
FIG. 13 is a left front perspective view of the economizer section of the second embodiment of the outdoor AHU, wherein the roof and exterior walls of the section housing are shown opaque.
Figure 14:
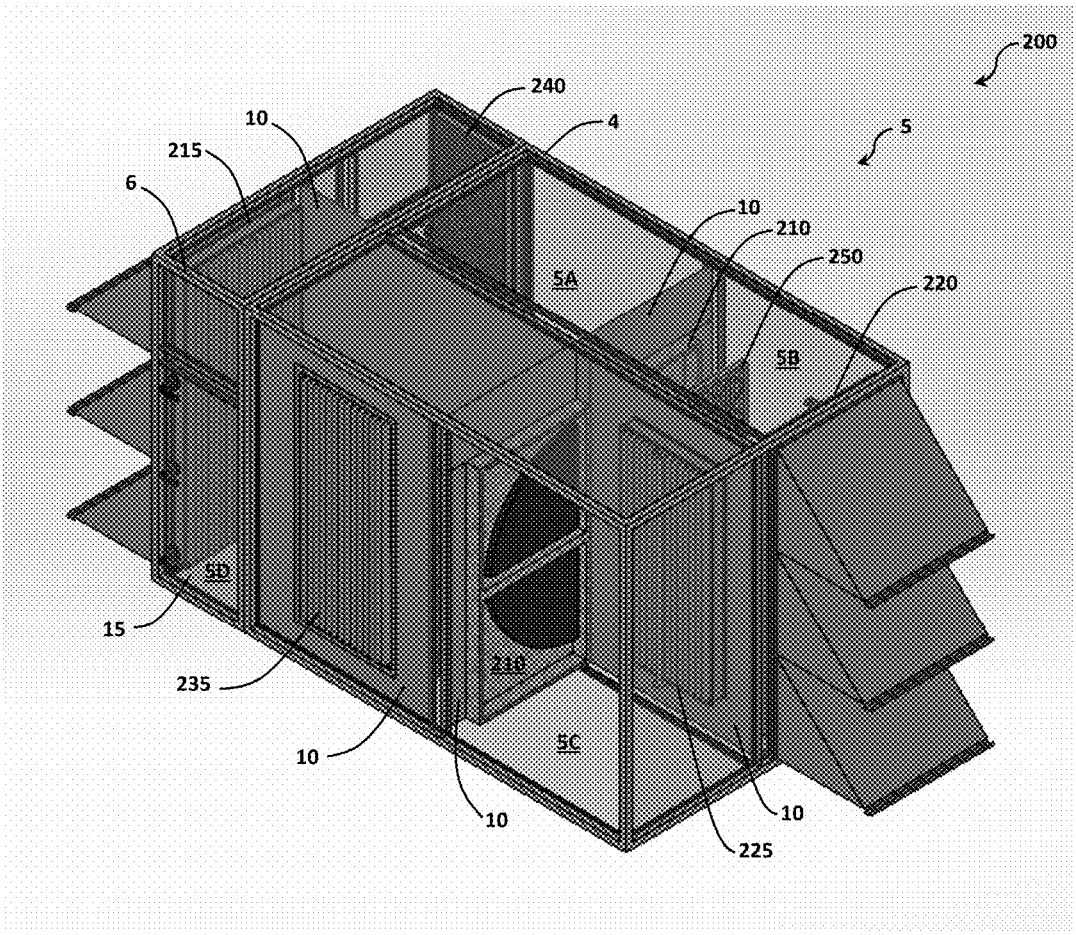
FIG. 14 is a right front perspective view of the economizer section of the second embodiment of the outdoor AHU, wherein the roof and exterior walls of the section housing are shown opaque.

The third economizer compartment 5C, is open to the adjacent filter section 7 such that the return airflow and/or the outside airflow may flow unobstructed from the third economizer compartment 5C to the filter section 7. The third economizer compartment 5C is bound by two partition walls of the plurality of partition walls, one of which it shares with the second economizer compartment 5B and the other which is shares with the fourth economizer compartment 5D. Additionally, it is also bound by one exterior wall of the plurality of exterior walls and a portion of the rotary enthalpy wheel 210, as shown in FIGS. 12 and 13.

The fourth economizer compartment 5D is bound by three partition walls of the plurality of partition walls, two exterior walls of the plurality of exterior walls, and a portion of the rotary enthalpy wheel 210. The two exterior walls of the fourth economizer compartment 5D may comprise either a first damper 240 or an access door of the plurality of access doors 15. The partition wall which bounds the fourth economizer compartment 5D and spans along the second end 6 provides a return air bypass damper 235, which allows the airflow of outside air to circumvent the rotary enthalpy plate 210 during economizer mode. The return air bypass damper 235 is substantially closed during normal mode of operation and substantially open during economizer mode of operation.

The rotary enthalpy plate 210 is positioned such that the direction of the airflows which pass through the rotary enthalpy plate 210 is directed at a substantially 90-degree angle relative to the longitudinal axis of the air tunnel 80, as shown in FIG. 9. The return air and outside air airstreams pass through the rotary enthalpy wheel 210 in substantially opposing directions.

During the normal mode of operation, the first damper 115 is modulated partially open to allow a predetermined minimum airflow volume of outside air to be pulled through the first damper 215 such that it enters the fourth economizer compartment 5D and traverses through the rotary enthalpy plate 210 to the third economizer compartment 5C wherein it mixes with the recirculated return air airstream and flows into the filter section 7 and, subsequently, into the plurality of downstream sections 8. Concurrently, the airflow of the return air is directed from the return air plenum section 2 through the return fan section 3 into the second economizer compartment 5B wherein a majority of the airflow volume passes through the recirculation damper 125 into the third economizer compartment 5C. The portion of the airflow volume of the return air that does not pass through the recirculation damper 125 flows through the rotary enthalpy plate 210 and into the first economizer compartment 5A wherein it is exhausted through the exhaust damper 140. The exhaust damper 240 is preferably actively controlled; however, it is anticipated that it may alternatively be passively controlled. Additionally, during the normal mode of operation, the recirculation damper 125 is actuated to a substantially open position. Conversely, during the normal mode of operation, the return air bypass damper 235 and the second damper 220 are actuated to a substantially closed position.

During the economizer mode, the supply air is substantially comprised entirely of outside air, which is pulled into the fourth economizer compartment 5D through the first damper 215, and the return air is exhausted through the second damper 220. Accordingly, the recirculation damper 225 is actuated to a substantially closed position and the first damper 215, second damper 220, and return air bypass damper 235 are each actuated to a substantially open position.

Third Embodiment

A third embodiment 300 of the present disclosure comprises an economizer section 5 for use within an indoor AHU 1, as shown in FIGS. 19-26, that may be operated in a plurality of modes. The plurality of modes comprises a normal mode of operation, an economizer mode, and a morning warm-up mode. However, it is anticipated that the economizer section 5 may accommodate AHUs 1 which require other modes of operation, such as daytime warm-up mode.

The energy recovery device utilized in the third embodiment 300 comprises a rotary enthalpy wheel 310. With the exception of a recirculation damper 325, the other dampers of a plurality of dampers utilized by the economizer section 5 are secured to the roof of the section housing. The other dampers include a first damper 315, a second damper 320, a third damper 330, and an exhaust damper 340. The first damper 315 is secured to the roof directly above the first economizer compartment 5A. The second damper 320 is secured to the roof directly above the fourth economizer compartment 5D. The third damper 330 is secured to the roof directly above the third economizer compartment 5C. The exhaust damper 340 is secured to the roof directly above the second economizer compartment 5B. The recirculation damper 325 is secured to a partition wall 10 located between the second and third economizer compartments 5B, 5C. The recirculation damper 325 is actively controlled and is substantially open during normal mode of operation and substantially closed during economizer mode of operation.

Figure 27:
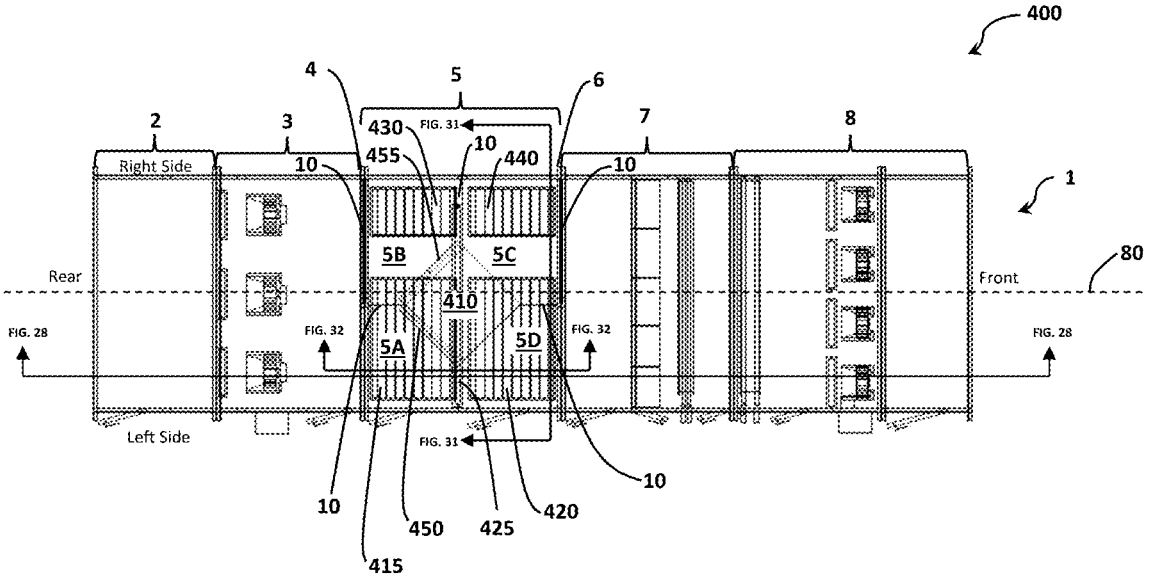
FIG. 27 is a top view of an indoor AHU, the top horizontal section of the section housing being removed from view, for a fourth embodiment of an economizer section with fixed enthalpy plates.
Figure 28:
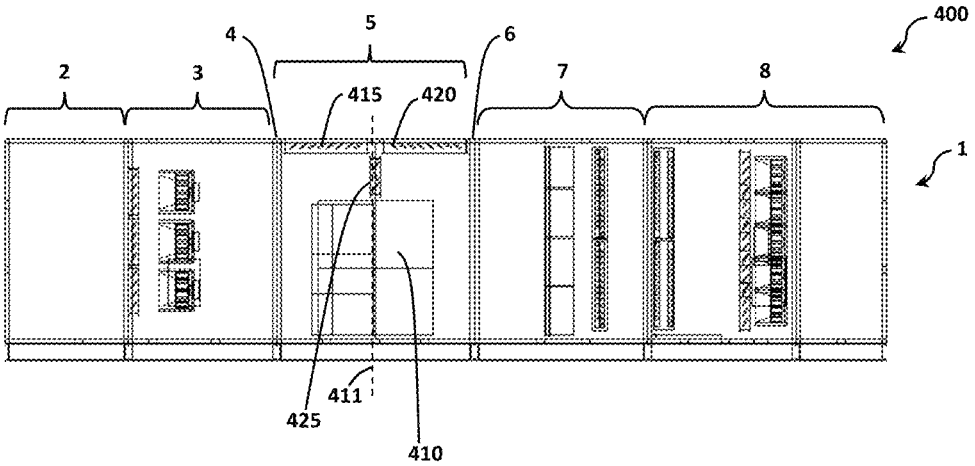
FIG. 28 is a longitudinal cross-sectional view of the indoor AHU of the fourth embodiment of the economizer section with fixed enthalpy plates, taken along line 28-28 in FIG. 27.

As a result of the positioning and orientation of the dampers, wherein the first, second, third, and exhaust dampers 315, 320, 330, 340 are secured to the roof of the section housing, the cross-sectional area of the economizer section 5 is substantially equal to the cross-sectional areas of the other sections 2,3,7,8 of the AHU 1 (i.e., the width and height of the economizer section 5 are substantially equal to the width and height of the other sections 2,3,7,8), as shown in FIGS. 27 and 28.

The first damper 315, when open, provides an exhaust for the substantial entirety of the return air airstream. The first and second dampers 315, 320 are substantially in phase with each another (i.e., both open and close at substantially the same time and by substantially the same amount). Accordingly, the second damper 320, when open, is configured to provide a substantially equal volume of outside air relative to the volume of return air that is exhausted by the first damper 315, when the first damper 315 is open. During the normal and economizer modes of operation the first and second dampers 315, 320 are out of phase with the recirculation, third, and exhaust dampers 325, 330, 340 (i.e., when the first and second dampers 315, 320 are open the other dampers 325, 330, 340 are closed).

During the normal mode of operation, the first and second dampers 315, 320 are closed and the recirculation, third, and exhaust dampers 325, 330, 340 are open. The third damper 330 provides a predetermined minimum airflow volume of outside air which is pulled into the third economizer compartment 5C. The predetermined minimum airflow volume of outside air then traverses from the third economizer compartment 5C through the rotary enthalpy plate 310 and into the fourth economizer compartment 5D, wherein it mixes with the recirculated return air. The mixed airflow then proceeds into the filter section 7 and, subsequently, into the plurality of downstream sections 8.

Additionally, during the normal mode of operation, the majority of the return air is recirculated such that it travels from the return fan section 3 into the first economizer compartment 5A, wherein it subsequently passes through the recirculation damper 325 into the fourth economizer compartment 5D. While in the fourth economizer compartment 5D the recirculated return air mixes with the predetermined minimum airflow volume of outside air. The mixed airflow then flows into the filter section 7 and, subsequently, into the plurality of downstream sections 8.

The third damper 330 is substantially open during the normal mode of operation and substantially closed during economizer mode. The exhaust damper 340 and third damper 330 are substantially in phase with each other, and, as a result, the volume of the return air exhausted through the exhaust damper 340 is substantially equal to the predetermined minimum airflow volume of outside air that is pulled in through the third damper 330. The volume of return air which is not recirculated flows from the first economizer compartment 5A through the rotary enthalpy wheel 310 into the second economizer compartment 5B, wherein it is exhausted through the exhaust damper 340.

Figure 21:
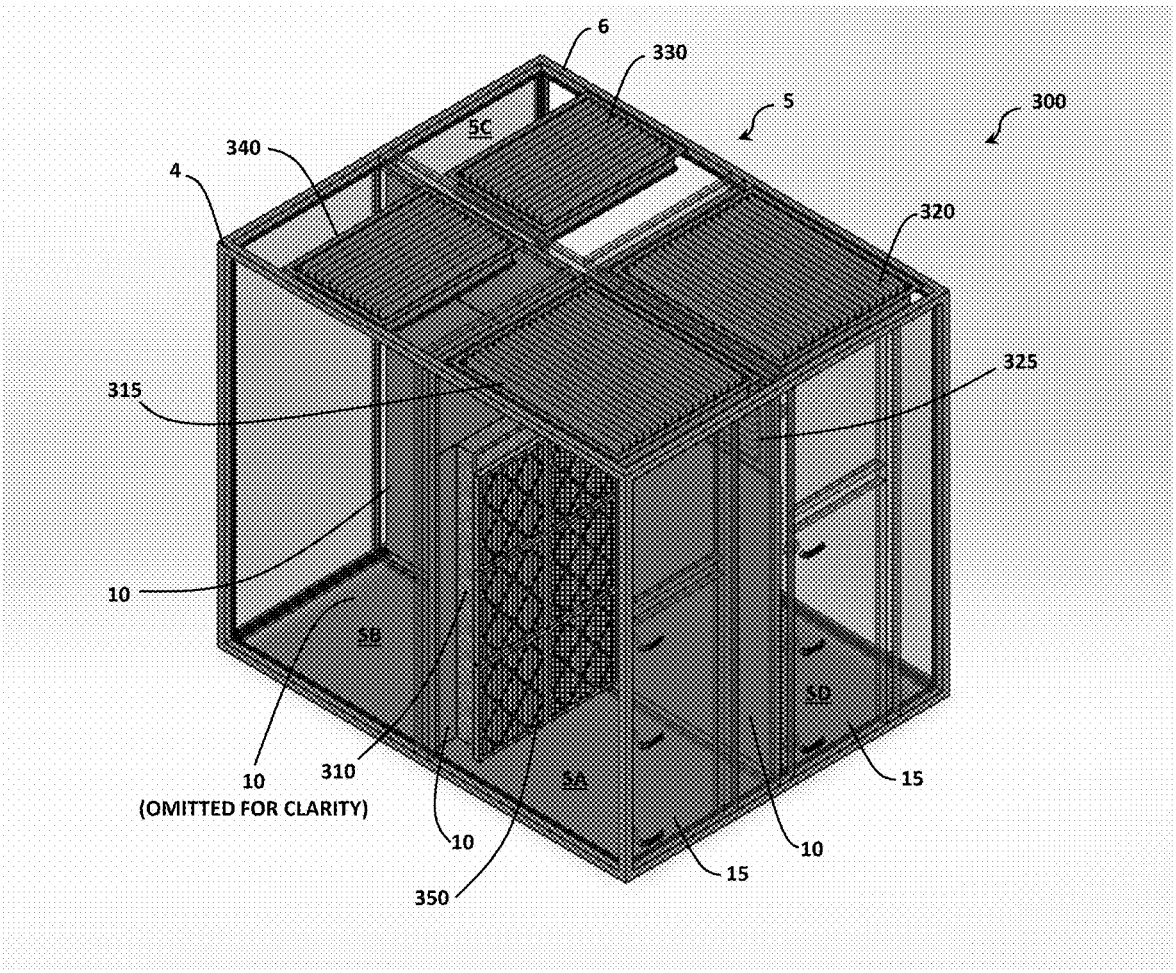
FIG. 21 is a left rear perspective view of the economizer section of the third embodiment of the indoor AHU, wherein the roof and exterior walls of the section housing are shown opaque and a partition wall separating a second economizer compartment from an adjacent section of the AHU is removed from view.
Figure 22:
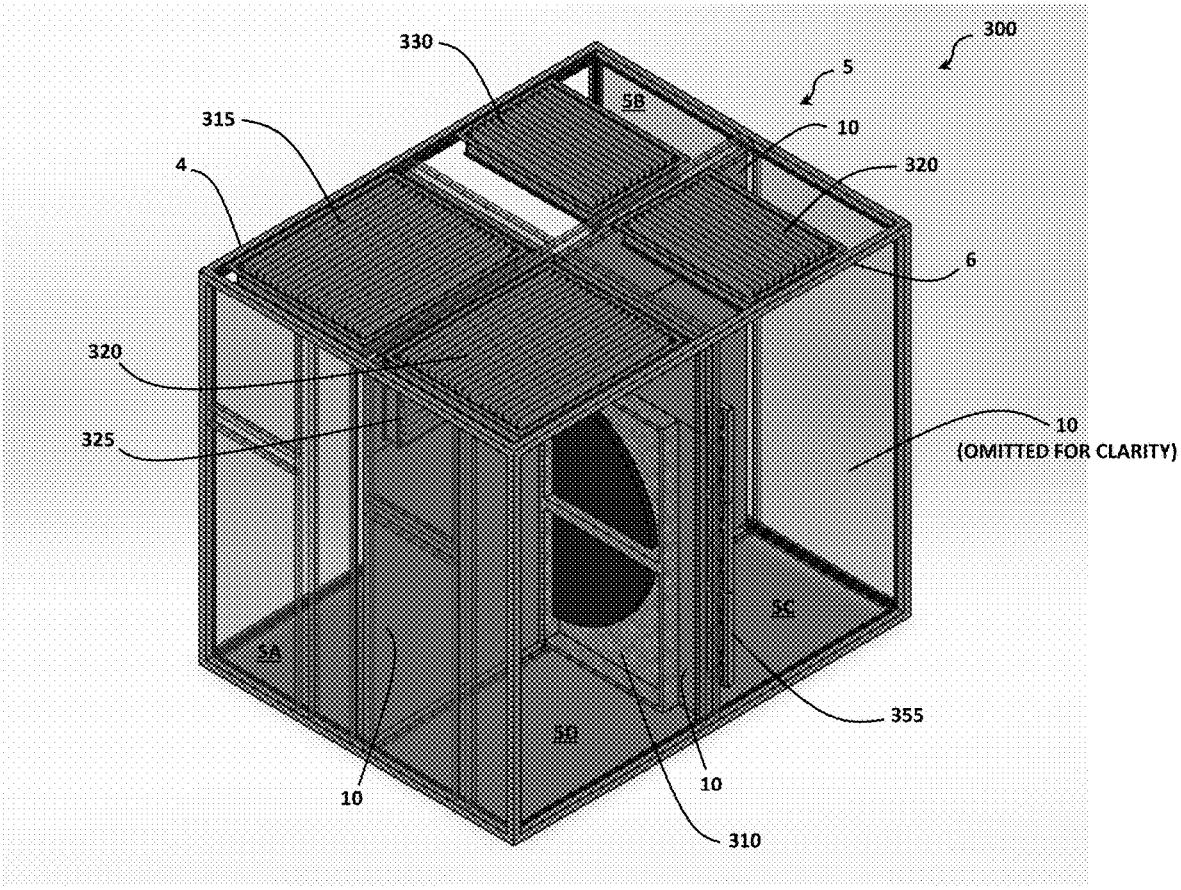
FIG. 22 is a left front perspective view of the economizer section of the third embodiment of the indoor AHU, wherein the roof and exterior walls of the section housing are shown opaque and a partition wall separating a third economizer compartment from an adjacent section of the AHU is removed from view.
Figure 23:
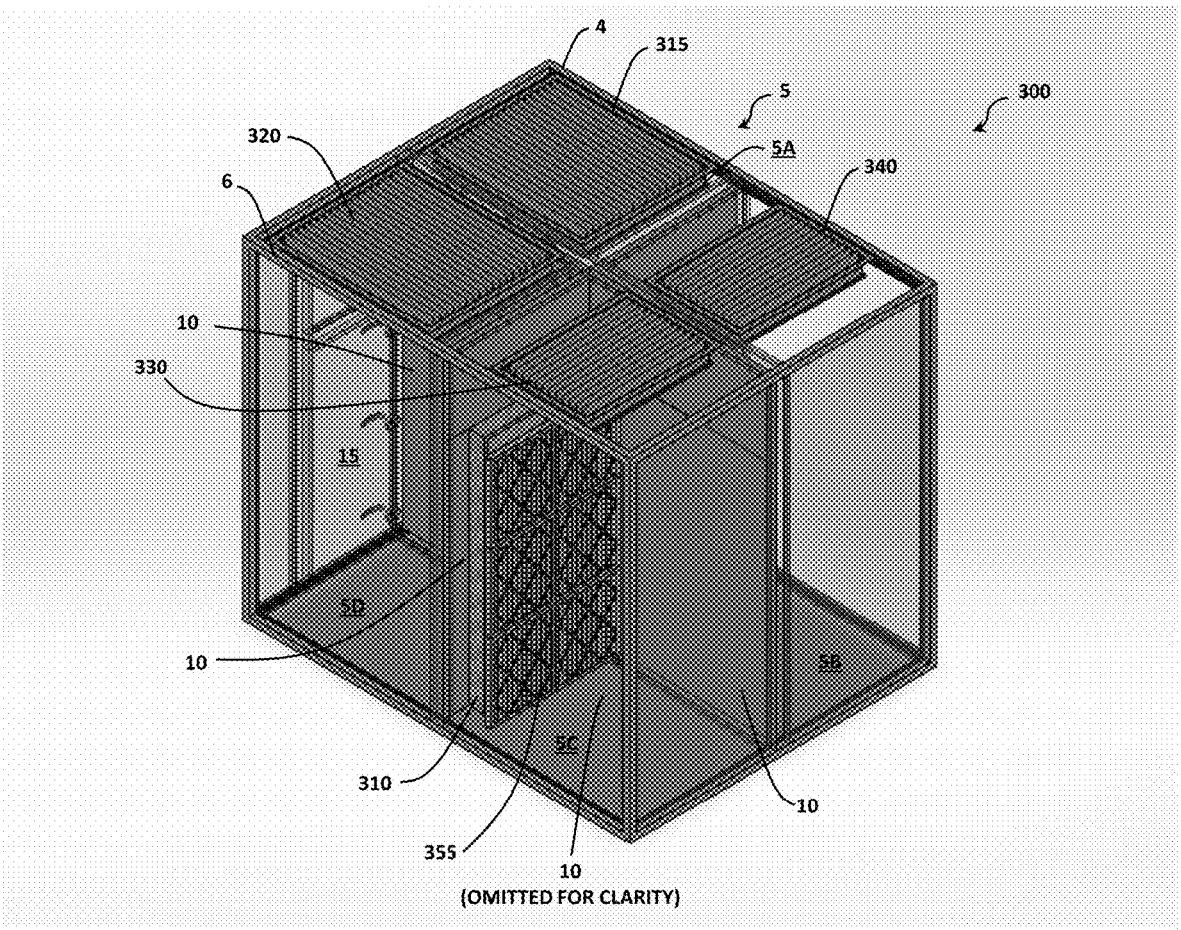
FIG. 23 is a right front perspective view of the economizer section of the third embodiment of the indoor AHU, wherein the roof and exterior walls of the section housing are shown opaque and the partition wall separating the third economizer compartment from the adjacent section of the AHU is removed from view.
Figure 24:
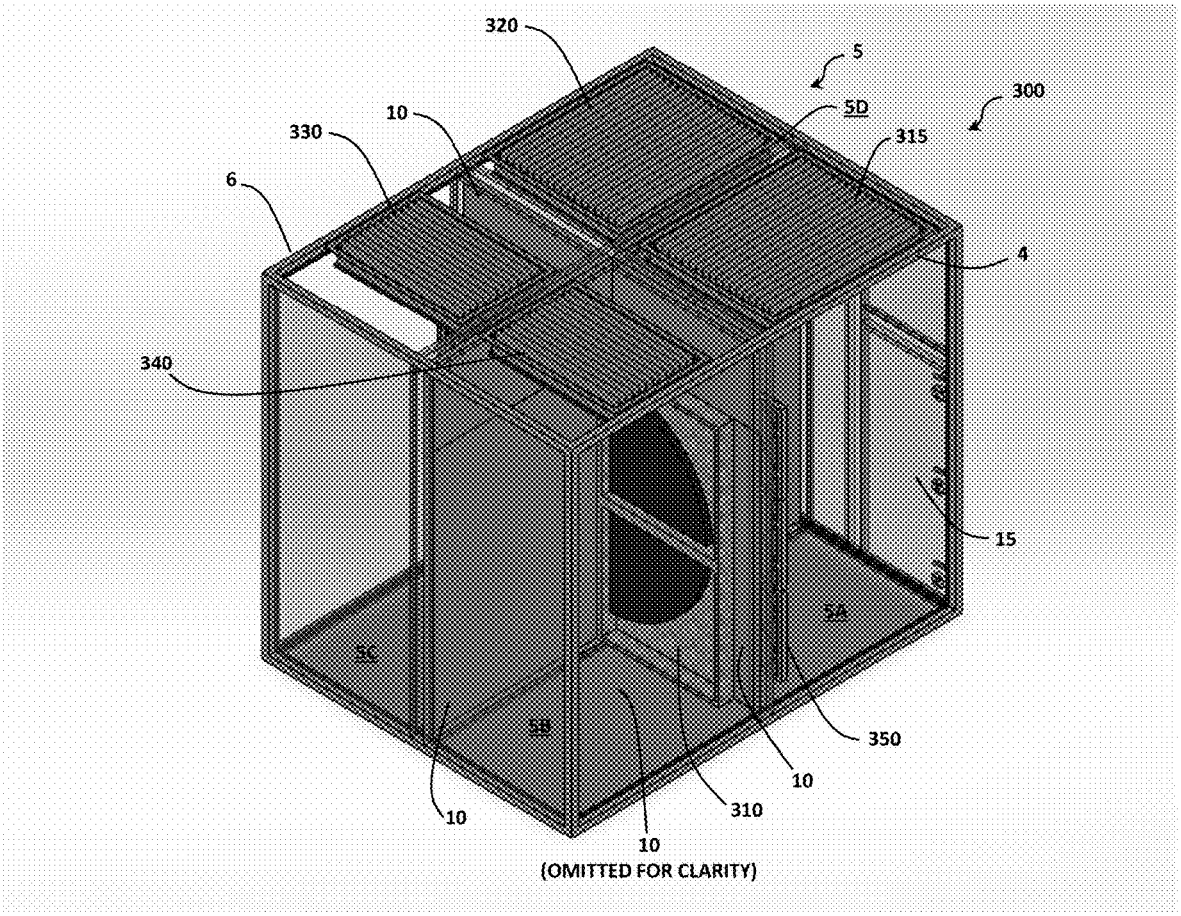
FIG. 24 is a right rear front perspective view of the economizer section of the third embodiment of the indoor AHU, wherein the roof and exterior walls of the section housing are shown opaque and the partition wall separating the second economizer compartment from the adjacent section of the AHU is removed from view.
Figure 25:
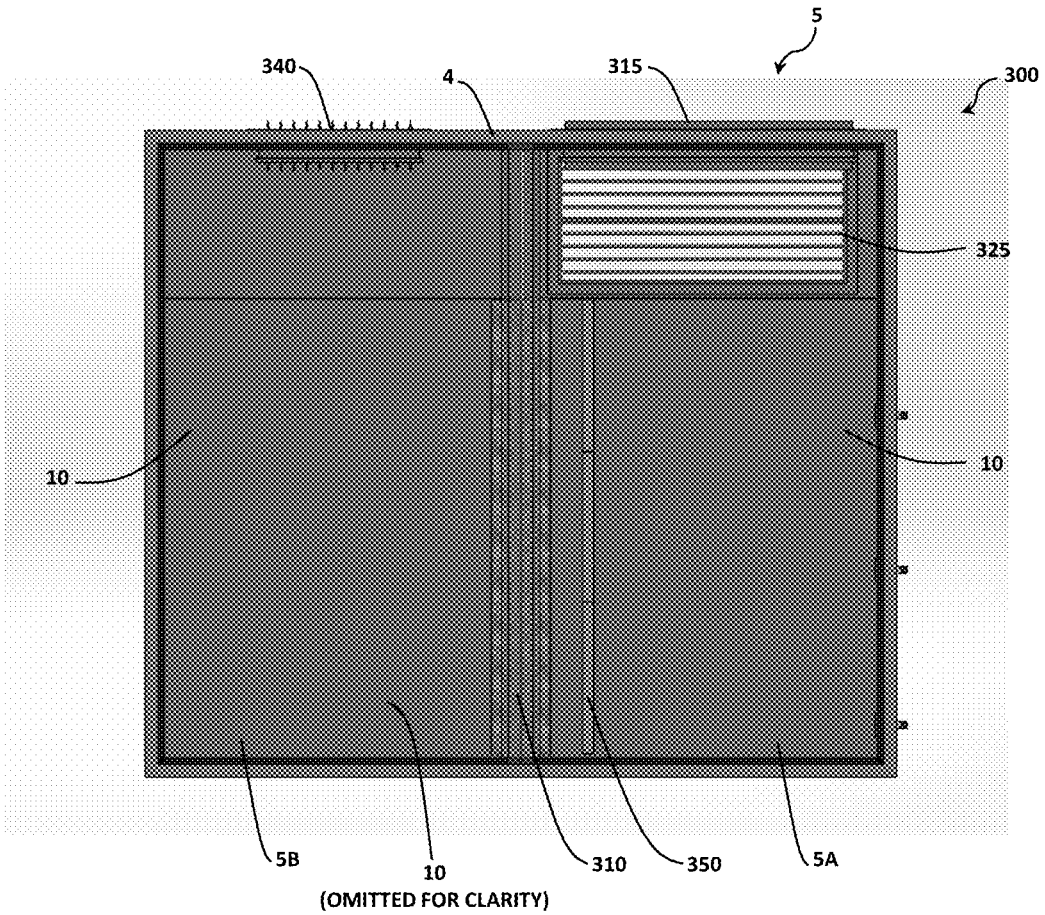
FIG. 25 is a rear view of the economizer section of the third embodiment of the indoor AHU, taken along line 25-25 in FIG. 24, wherein the partition wall separating the second economizer compartment from the adjacent section of the AHU is removed from view.
Figure 26:
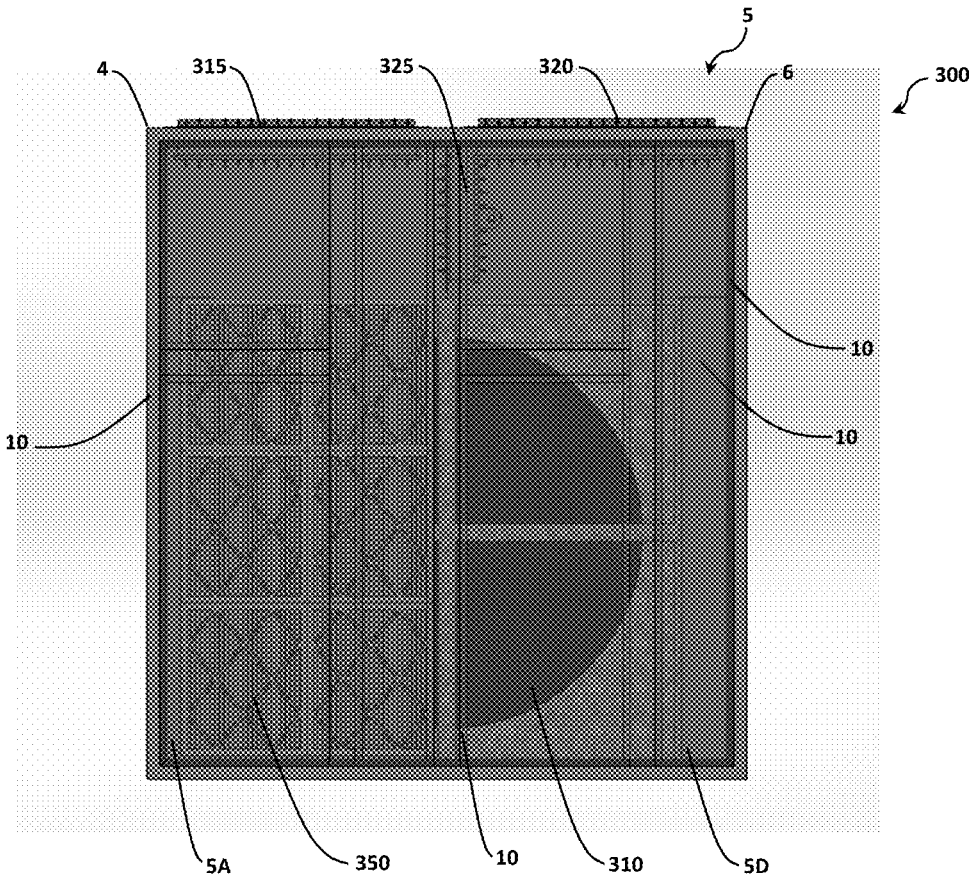
FIG. 26 is a rear view of the economizer section of the third embodiment of the indoor AHU, taken along line 26-26 in FIG. 24, wherein the exterior walls are shown in opaque.

The first economizer compartment 5A is open to the adjacent return fan section 3, such that the return air airstream can flow substantially unobstructed from the return fan section 3 to the first economizer compartment 5A. The bounding sides of the first economizer compartment 5A comprise two partition walls of the plurality of partition walls 10, one exterior wall of the plurality of exterior walls, and one vertical surface of a portion of the rotary enthalpy wheel 310, as shown in FIG. 21. One of the two partition walls separates the first economizer compartment 5A from the fourth economizer compartment 5D and provides the recirculation damper 325. The exterior wall that bounds the first economizer compartment 5A comprises an access door of the plurality of access doors 15.

The bounding sides of the second economizer compartment 5B are comprised of at least three partition walls of the plurality of partition walls 10, one of which it shares with the first economizer compartment 5A and another which it shares with the third economizer compartment 5C. The other partition wall spans along the first end 4 and separates the second economizer compartment 5B from the return fan section 3. The second economizer compartment 5B is also bounded by an exterior wall of the plurality of exterior walls.

Figure 19:
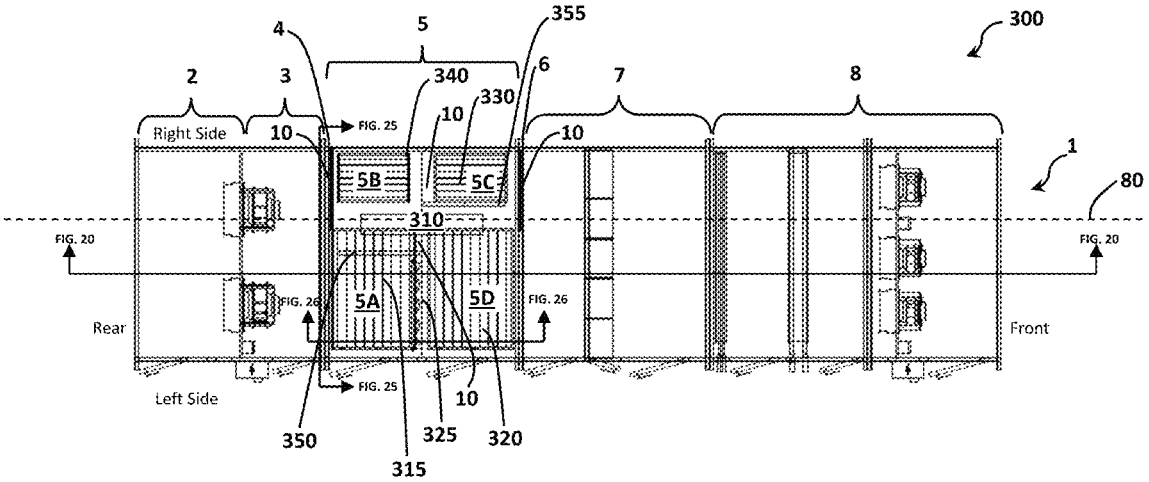
FIG. 19 is a top view of an indoor AHU, the top horizontal section of the section housing being removed from view, for a third embodiment of an economizer section with energy recovery wheel.
Figure 20:
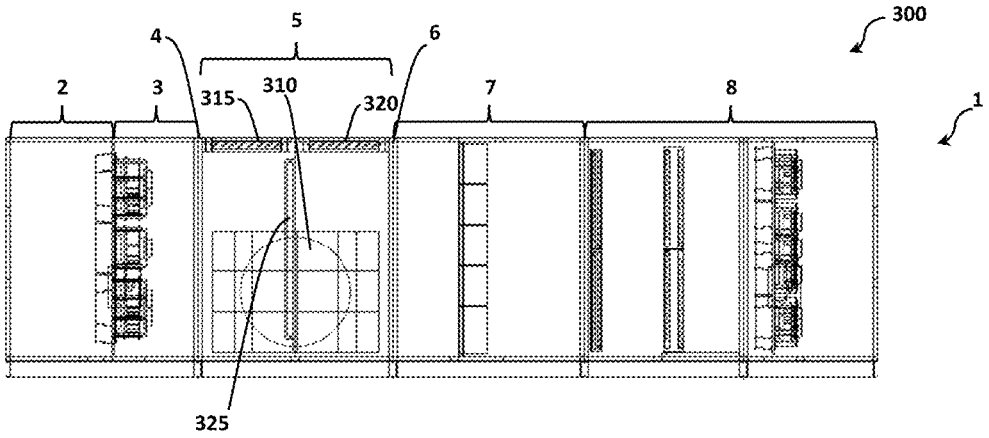
FIG. 20 is a cross-sectional section view of the AHU of the third embodiment, taken along line 20-20 in FIG. 19.

The third economizer compartment 5C is bound by at least three partition walls 10, one of which it shares with the second economizer compartment 5B and another which is shares with the fourth economizer compartment 5D. The third economizer compartment 5C, is separated from the adjacent filter section 7 by another partition wall, as schematically shown in FIG. 19. The third economizer compartment 5C is also bound by an exterior wall of the plurality of exterior walls and a portion of the rotary enthalpy wheel 310.

The fourth economizer compartment 5D is bound by two partition walls of the plurality of partition walls 10, and one exterior wall of the plurality of exterior walls, and a portion of the rotary enthalpy wheel 310. The fourth economizer compartment 5D is open to the adjacent filter section 7 such that airflow is substantially unobstructed from flowing from the fourth economizer compartment 5D to the filter section 7.

The rotary enthalpy plate 310 is positioned such that the direction of the airflows which pass through the rotary enthalpy plate 310 is directed at a substantially 90-degree angle relative to the longitudinal axis of the air tunnel 80. The return and outside airflow paths pass through the rotary enthalpy wheel 310 in substantially opposing directions.

During the economizer mode, the supply air is substantially entirely comprised of outside air, which is pulled into the fourth economizer compartment 5D through the second damper 320, which is modulated to an substantially open position. Concurrently, the substantial entirety of the return air airstream is exhausted through the first damper 315. During the economizer mode, the exhaust damper 340, recirculation damper 325, and third damper 330 are substantially closed.

Fourth Embodiment

A fourth embodiment 400 of the present disclosure comprises an economizer section 5 for use within an indoor AHU 1, as shown in FIGS. 27-32, which may be operated in a plurality of modes. The plurality of modes comprises a normal mode of operation, an economizer mode, and a morning warm-up mode. However, it is anticipated that the economizer section 5 may accommodate AHUs 1 which require other modes of operation, such as daytime warm-up mode.

Figure 29:
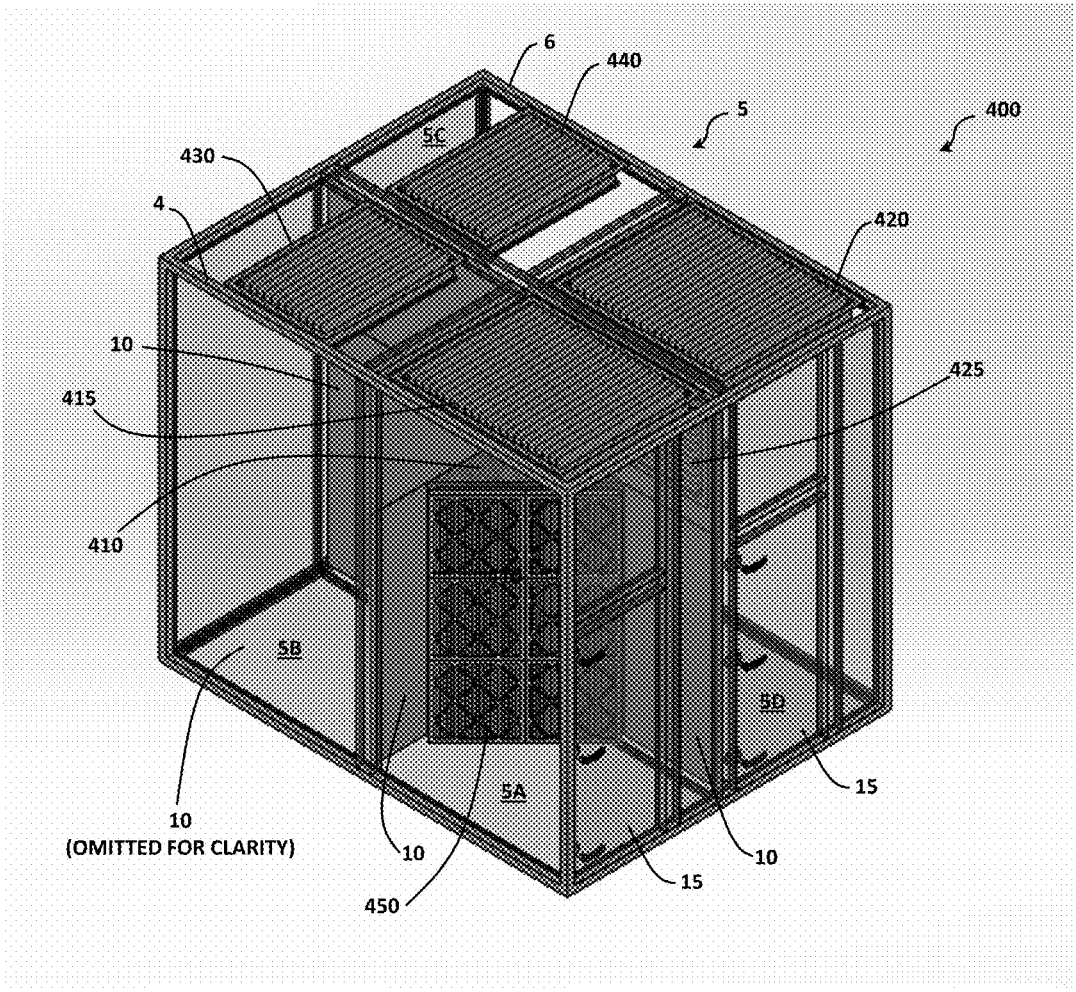
FIG. 29 is a left rear perspective view of the fourth embodiment of the economizer section for the indoor AHU, wherein the roof and exterior walls of the section housing are shown opaque and a partition wall separating the second economizer compartment from an adjacent section of the indoor AHU is removed from view.

The economizer section 5 further comprises fixed enthalpy plates 410. Alternatively, in higher capacity AHUs 1 a plurality of stacks of fixed enthalpy plates 410 may be used (not shown). The fixed enthalpy plates 410 comprise a substantially rectangular cuboid profile with six surfaces. The six surfaces are preferably comprised of four substantially vertical surfaces and two substantially horizontal surfaces. Each vertical surface is positioned such that is forms one of the bounding sides of the plurality of bounding sides for each of the economizer compartments 5A, 5B, 5C, 5D. The vertical surface which bounds the first economizer compartment 5A provides an outside air filter 455, as shown in FIG. 29.

The first economizer compartment 5A is open to the adjacent return fan section 3 such that the return air airstream can flow substantially unobstructed from the return fan section 3 into the first economizer compartment 5A. The bounding sides of the first economizer compartment 5A are comprised of at least two partition walls of the plurality of partition walls 10, one exterior wall of the plurality of exterior walls, and one vertical surface of the four vertical surfaces of the fixed enthalpy plates 410, as shown in FIG. 29. One of the two partition walls which bounds the first economizer compartment 5A separates the first economizer compartment 5A from the fourth economizer compartment 5D and provides a recirculation damper 425. The exterior wall that bounds the first economizer compartment 5A comprises an access door of the plurality of access doors 15. The recirculation damper 425 is substantially open during normal mode of operation and substantially closed during the economizer mode of operation. Additionally, directly above the first economizer compartment 5A is a first damper 415. The first damper 415 is utilized as an exhaust for return airflow during the economizer mode of operation.

The bounding sides of the second economizer compartment 5B are comprised of three partition walls of the plurality of partition walls 10, one of which it shares with the first economizer compartment 5A and another which it shares with the third economizer compartment 5C. The other partition wall spans along the first end 4 and separates the second economizer compartment from the return fan section 3, as schematically shown in FIG. 27. The second economizer compartment 5B is also bounded by an exterior wall of the plurality of exterior walls. A third damper 430 is secured directly to the roof of the section housing above the second economizer compartment 5B. The third damper 430 provides a predetermined volume of minimum outside air during the normal mode of operation. Accordingly, the third damper 430 is substantially open during the normal mode of operation and substantially closed during economizer mode of operation.

Figure 30:
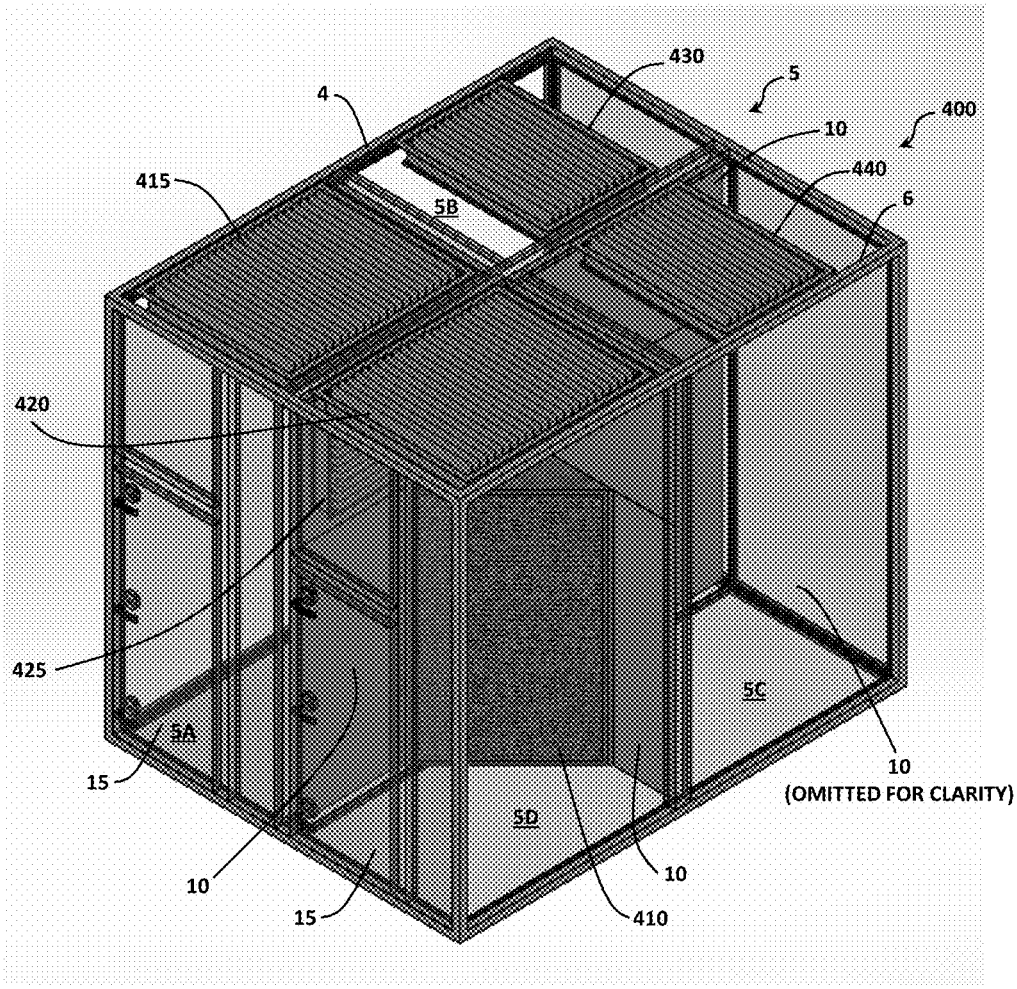
FIG. 30 is a left front perspective view of the economizer section of the fourth embodiment of the indoor AHU, wherein the roof and exterior walls of the section housing are shown opaque and a partition wall separating the third economizer compartment from an adjacent section of the indoor AHU is removed from view.
Figure 31:
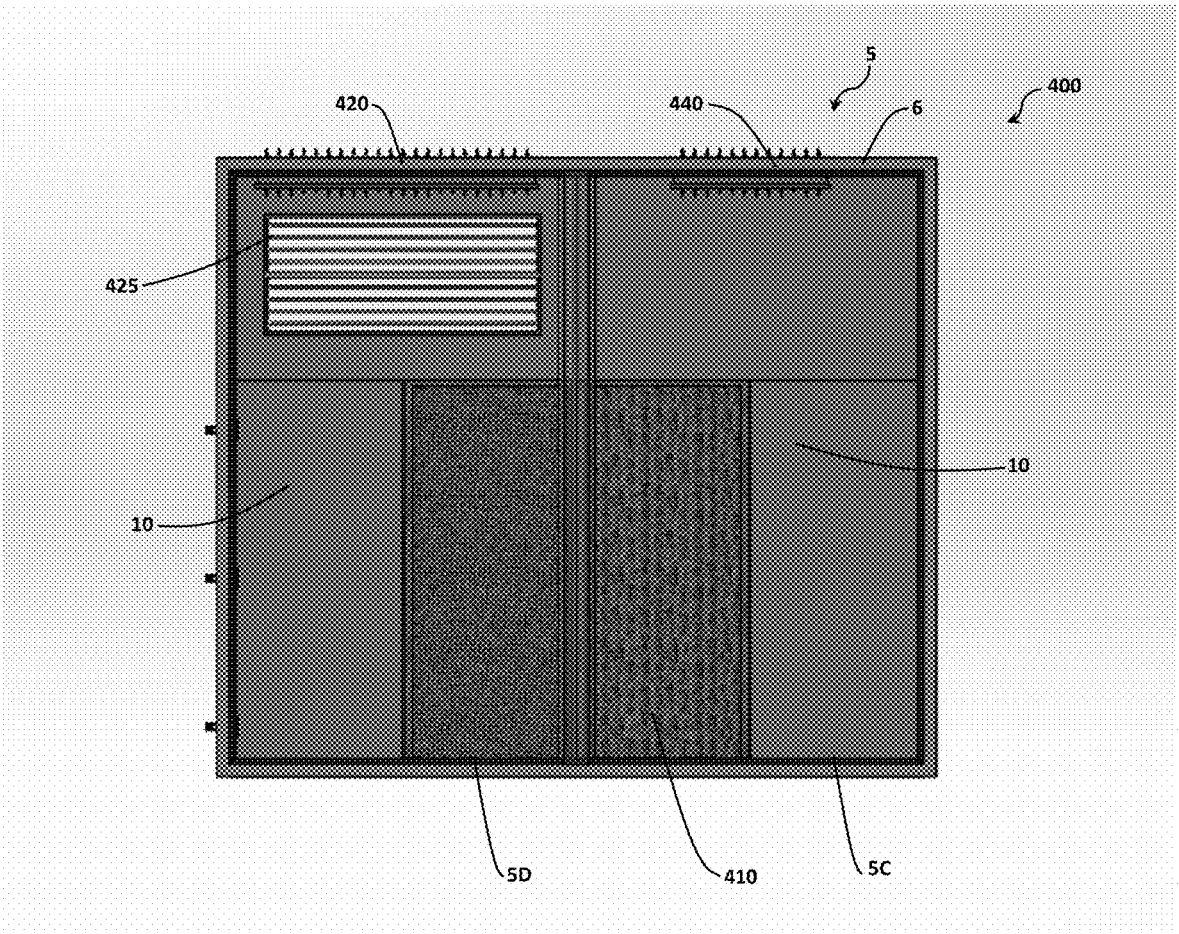
FIG. 31 is a front view of the economizer section of the fourth embodiment for the indoor AHU, wherein the partition wall separating the third economizer compartment from the adjacent section of the indoor AHU is removed from view.
Figure 32:
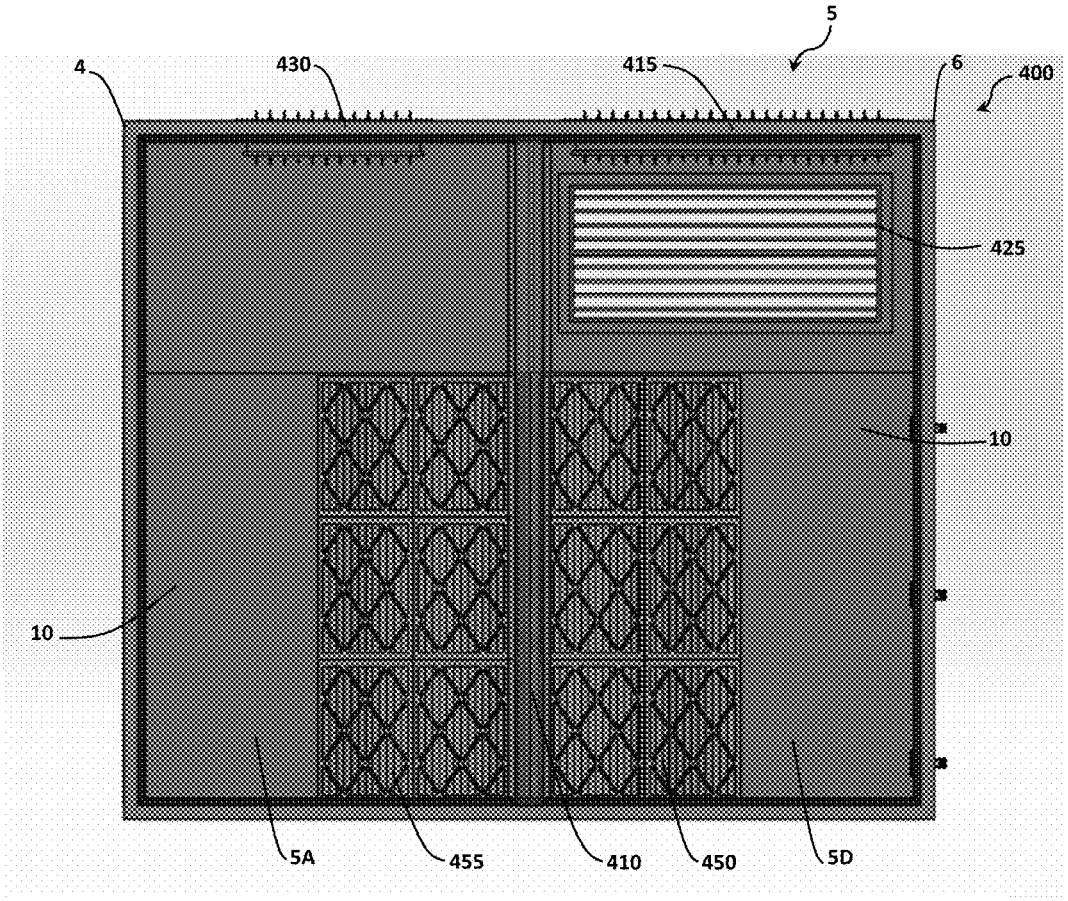
FIG. 32 is a rear view of the economizer section of the fourth embodiment for the indoor AHU, wherein the partition wall separating the second economizer compartment from the adjacent section of the indoor AHU is removed from view.

The third economizer compartment 5C is separated from the adjacent filter section 7 by a partition wall 10 such that airflow is substantially prevented from directly flowing from the third economizer compartment 5C to the filter section 7. The third economizer compartment 5C is bound by three partition walls 10, one of which it shares with the second economizer compartment 5B, another which it shares with the fourth economizer compartment 5D, and another which spans substantially along the second end 6. Additionally, it is also bound by one exterior wall of the plurality of exterior walls and one of the vertical surfaces of the fixed enthalpy plates 410. Additionally, directly above the third economizer compartment 5C is an exhaust damper 440, as shown in FIG. 30. The exhaust damper 440 is substantially open during the normal mode of operation and provides exhaust for a portion of the return air that does not pass through the recirculation damper 425. The exhaust damper 460 is substantially closed during economizer mode of operation.

The fourth economizer compartment 5D is bound by two partition walls of the plurality of partition walls 10, one exterior wall of the plurality of exterior walls, and one vertical surface of the fixed enthalpy plates 410, as shown in FIG. 30. The exterior wall comprises an access door of the plurality of access doors 15. Additionally, directly above the fourth economizer compartment 5D is a second damper 420. The second damper 415 is utilized to draw in outside air during the economizer mode of operation. Accordingly, during the normal mode of operation the second damper 420 is substantially closed and, conversely, substantially open during economizer mode of operation.

The fixed enthalpy plates 410 are positioned such that the direction of the airflows which pass through the fixed enthalpy plates 410 are each respectfully directed at a substantially 45-degree angle relative to the longitudinal axis of the air tunnel 80. During normal mode of operation, the return air and outside air airstreams respectively flow substantially perpendicular relative to each other as well as relative to a vertical axis 411 of the fixed enthalpy plates 410, as shown in FIG. 28.

During the normal mode of operation, a predetermined minimum airflow volume of outside air is pulled through the third damper 430. Upon passing through third damper 430 the outside air then flows from the second economizer compartment 5B, through the fixed enthalpy plates 410, to the fourth economizer compartment 5D, wherein it mixes with the recirculated return air and then proceeds into the filter section 7 and, subsequently, into the plurality of downstream sections 8. Concurrently, the airflow of the return air is directed from the return air plenum section 2 through the return fan section 3 into the first economizer compartment 5A wherein a majority of the return air airstream passes through the recirculation damper 425. The portion of the return air that does not pass through the recirculation damper 425 is directed through the fixed enthalpy plates 410 and into the third economizer compartment 5C wherein it is exhausted through the exhaust damper 440. During the normal mode of operation the recirculation damper 425, exhaust damper 440, and third damper 430 are substantially open. Conversely, during the normal mode of operation, the first and second dampers 415, 420 are substantially closed. The exhaust damper 440 is actively controlled and modulated to a closed position during economizer mode. However, it is anticipated that it may alternatively be passively controlled.

During the economizer mode of operation, the supply air is substantially comprised entirely of outside air, which is pulled into the fourth economizer compartment 5D through the second damper 420 and the substantial entirety of the return air airstream is exhausted through the first damper 415. As such, during the economizer mode of operation, the first and second dampers 415, 420 are substantially open and the exhaust, recirculation, and third dampers 440, 425, 430 are substantially closed.

While the foregoing exemplary non-limiting embodiments of the adaptive economizer system have been disclosed herein, certain modifications may be made by those skilled in the art to modify the embodiments without departing from the spirit of the invention.

What is claimed:

1. An economizer section for retrofitting an air tunnel of an existing air handling unit, the economizer section comprising:

a. a section housing having a first end and an opposing second end, each of the first end and the second end are configured to couple to an associated air tunnel of an associated air handling unit, the section housing having a central axis parallel to a longitudinal axis of the associated air tunnel of the associated air handling unit;
   i. wherein the section housing comprises a variety of structural elements;
   ii. wherein the variety of structural elements comprise a floor, and a plurality of exterior walls;
   iii. wherein the section housing further comprises a plurality of partition walls;
   iv. wherein each partition wall of the plurality of partition walls is securely attached to one or more structural elements of the variety of structural elements;
   v. wherein the section housing is located downstream relative to a return fan section of an air handling unit and upstream relative to a filter section of the air handling unit;

b. an energy recovery device;
   i. wherein the energy recovery device is securely attached to two or more partition walls;
   ii. wherein the energy recovery device comprises at least two vertical surfaces;

c. a plurality of compartments;
   i. wherein each respective compartment of the plurality of compartments is bounded by at least one exterior wall, at least two partition walls, and one vertical surface of the at least two vertical surfaces of the energy recovery device;

d. a plurality of dampers;
   i. wherein each damper of the plurality of dampers is secured to the section housing;
   ii. wherein the plurality of dampers is configurable to direct airflow for a plurality of modes of operation of the air handling unit;
   iii. wherein the plurality of modes of operation of the air handling unit comprises a normal mode of operation and an economizer mode of operation;
   iv. wherein the plurality of dampers create at least three airflow paths during the normal mode of operation of the air handling unit;
   v. wherein two of the at least three air paths created by the plurality of dampers during the normal mode of operation converge with one another within the economizer section;
   vi. wherein the plurality of dampers create at least two airflow paths during the economizer mode of operation of the air handling unit;
   vii. wherein the at least two airflow paths created by the plurality of dampers during the economizer mode of operation do not mix within one another within the economizer section;
   viii. wherein one of the plurality of dampers is configurable to direct outside airstreams flow substantially perpendicular relative to longitudinal axis of the associated air tunnel;
   ix. wherein airflow passing through the energy recovery device is directed at a substantially 90-degree angle relative to the central axis of the section housing.

2. The economizer section as described in claim 1, wherein the plurality of dampers comprises a first damper, a second damper, a third damper, a fourth damper, and a recirculation damper.

3. The economizer section as described in claim 1, wherein the two airflow paths that converge within the economizer section during the normal mode of operation comprise a predetermined volume of outside air and a predetermined volume of return air.

4. The economizer section as described in claim 1, wherein one of the at least three airflow paths created by the plurality of dampers during the normal operation of the air handling unit is exhausted out of the economizer section through one or more dampers of the plurality of dampers.

5. The economizer section as described in claim 1, wherein the plurality of compartments comprises a first economizer compartment, a second economizer compartment, a third economizer compartment, and a fourth economizer compartment.

6. The economizer section as described in claim 1, wherein each economizer compartment is located adjacent to at least two other economizer compartments.

7. The economizer section as described in claim 6, wherein each economizer compartment shares at least one partition wall with an adjacent economizer compartment.

8. An economizer section for retrofitting an air tunnel of an existing air handling unit, the economizer section comprising:

a. a section housing having a first end and an opposing second end, each of the first end and the second end are configured to couple to an associated air tunnel of an associated air handling unit, the section housing having a central axis parallel to a longitudinal axis of the associated air tunnel of the associated air handling unit;
   i. wherein the section housing comprises a variety of structural elements;
   ii. wherein the variety of structural elements comprise a floor, and a plurality of exterior walls;
   iii. wherein the section housing further comprises a plurality of partition walls;
   iv. wherein each partition wall of the plurality of partition walls is securely attached to one or more structural elements of the variety of structural elements;

b. an energy recovery device;
   i. wherein the energy recovery device is securely attached to two or more partition walls;
   ii. wherein the energy recovery device comprises at least two vertical surfaces;

c. a plurality of compartments;
   ii. wherein each respective compartment of the plurality of compartments is bounded by at least one exterior wall, at least two partition walls, and one vertical surface of the at least two vertical surfaces of the energy recovery device;

d. a plurality of dampers;
   i. wherein each damper of the plurality of dampers is secured to the section housing;
   ii. wherein the plurality of dampers is configurable to direct airflow for a plurality of modes of operation of an air handling unit;

iii. wherein the plurality of modes of operation of the air handling unit comprises a normal mode of operation and an economizer mode of operation:

iv. wherein one of the plurality of dampers is configurable to direct outside airstreams flow substantially perpendicular relative to longitudinal axis of the associated air tunnel; and v. wherein airflow passing through the energy recovery device is directed at a substantially 90-degree angle relative to the central axis of the section housing.

9. The economizer section as described in claim 8, wherein the section housing is located downstream relative to a return fan section of the air handling unit and upstream relative to a filter section of the air handling unit.

10. The economizer section as described in claim 8, wherein the plurality of compartments comprises a first economizer compartment, a second economizer compartment, a third economizer compartment, and a fourth economizer compartment.

11. The economizer section as described in claim 8, wherein the plurality of dampers comprises a first damper, a second damper, a third damper, a fourth damper, and a recirculation damper.

12. The economizer section as described in claim 8, wherein the plurality of dampers is configured during the normal mode of operation of the air handling unit to create at least three airflow paths.

13. The economizer section as described in claim 8, wherein two of the at least three air paths created by the plurality of dampers during the normal mode of operation converge with one another within the economizer section.

14. The economizer section as described in claim 8, wherein the plurality of dampers is configured during the economizer mode of operation of the air handling unit to create at least two airflow paths.

15. The economizer section as described in claim 14, wherein the at least two airflow paths created by the plurality of dampers during the economizer mode of operation do not mix within one another within the economizer section.

16. The economizer section as described in claim 13, wherein the two airflow paths that converge within the economizer section during the normal mode of operation of the air handling unit comprise a predetermined volume of outside air and a predetermined volume of return air.

17. The economizer section of claim 1, wherein the energy recovery device comprises a rotary enthalpy wheel.

18. The economizer section of claim 8, wherein the energy recovery device comprises a rotary enthalpy wheel.

* * * * *